US011037536B2

(12) United States Patent
Sikra

(10) Patent No.: US 11,037,536 B2
(45) Date of Patent: Jun. 15, 2021

(54) DIRECT DRIVE PERCUSSION PEDAL SYSTEM

(71) Applicant: Drum Workshop, Inc., Oxnard, CA (US)

(72) Inventor: Richard A. Sikra, Thousand Oaks, CA (US)

(73) Assignee: Drum Workshop, Inc., Oxnard, CA (US)

( * ) Notice: Subject to any disclaimer, the term of this patent is extended or adjusted under 35 U.S.C. 154(b) by 46 days.

(21) Appl. No.: 16/255,503

(22) Filed: Jan. 23, 2019

(65) Prior Publication Data

US 2019/0156796 A1 May 23, 2019

Related U.S. Application Data

(63) Continuation-in-part of application No. 15/409,428, filed on Jan. 18, 2017, now Pat. No. 10,867,589.

(60) Provisional application No. 62/621,563, filed on Jan. 24, 2018, provisional application No. 62/623,315, filed on Jan. 29, 2018, provisional application No. 62/281,089, filed on Jan. 20, 2016.

(51) Int. Cl.
*G10D 13/11* (2020.01)

(52) U.S. Cl.
CPC ..... *G10D 13/11* (2020.02)

(58) Field of Classification Search
CPC ..... G10D 13/006
USPC ..... 84/422.1
See application file for complete search history.

(56) References Cited

U.S. PATENT DOCUMENTS

| | | | | |
|---|---|---|---|---|
| 3,147,661 | A | 9/1964 | Padera | |
| 3,747,464 | A | 7/1973 | Russell | |
| 4,747,333 | A * | 5/1988 | Hoshino | G10D 13/11 84/422.1 |
| 5,301,592 | A | 4/1994 | Johnston | |
| 5,994,635 | A * | 11/1999 | Hoshino | G10D 13/11 84/422.1 |
| 6,281,089 | B1 | 8/2001 | Chen | |
| 6,590,147 | B2 | 7/2003 | Kassabian | |
| 6,794,565 | B2 | 9/2004 | Green | |
| 6,906,252 | B2 | 6/2005 | Matsuzoe | |
| 7,262,356 | B1 | 6/2007 | Lukios | |
| 7,365,258 | B1 | 4/2008 | Lombardi | |
| 8,455,746 | B2 | 6/2013 | Johnston | |

(Continued)

FOREIGN PATENT DOCUMENTS

DE 202010004042 U1 * 7/2010 ..... G10D 13/11

OTHER PUBLICATIONS

Office Action for U.S. Appl. No. 15/409,428; dated Sep. 5, 2019.

(Continued)

*Primary Examiner* — Jianchun Qin
(74) *Attorney, Agent, or Firm* — Ferguson Case Orr Paterson

(57) ABSTRACT

Drum pedal systems are disclosed which can include separate pedal and beater portions connected by a connecting portion. The connecting portion can be flexible such that the location of the beater portion can be adjusted relative to the location of the pedal portion. The pedal and beater portions can be disconnected from one another for improved transportability. Direct drive pedal systems are also disclosed, which can include separate pedal and beater portions connected by a direct drive connecting portion having rigid connections.

21 Claims, 16 Drawing Sheets

(56) References Cited

U.S. PATENT DOCUMENTS

| | | | | |
|---|---|---|---|---|
| 8,624,097 | B1 | 1/2014 | Liao | |
| 9,087,497 | B1 | 7/2015 | Krol | |
| D786,337 | S | 5/2017 | Chandontrikit | |
| 9,875,730 | B2 * | 1/2018 | Cannon | G10D 13/11 |
| 2006/0150801 | A1 | 7/2006 | Veiga | |
| 2008/0173159 | A1 * | 7/2008 | Chen | G10D 13/11 84/422.1 |
| 2011/0271818 | A1 * | 11/2011 | Simon | G10D 13/11 84/422.1 |
| 2012/0097011 | A1 | 4/2012 | Leopold | |
| 2012/0144976 | A1 | 6/2012 | Johnston | |
| 2012/0180617 | A1 | 7/2012 | Dorfman | |
| 2015/0059555 | A1 * | 3/2015 | Liao | G10D 13/12 84/422.1 |
| 2015/0082968 | A1 | 3/2015 | Sikra | |
| 2016/0210946 | A1 | 7/2016 | Sikra | |

OTHER PUBLICATIONS

International Search Report of Application No. PCT/US17/13993; dated Oct. 5, 2017.
Office Action for U.S. Appl. No. 15/873,269; dated Feb. 21, 2020.
Office Action for U.S. Appl. No. 15/873,269; dated Jul. 15, 2020.

* cited by examiner

DIRECT DRIVE PERCUSSION PEDAL SYSTEM

This application claims the priority benefit of U.S. Provisional Pat. App. No. 62/621,563 to Sikra, filed on Jan. 24, 2018 and entitled "Direct Drive Percussion Pedal System"; and claims the priority benefit of U.S. Provisional Pat. App. No. 62/623,315 to Sikra, filed on Jan. 29, 2018 and entitled "Direct Drive Percussion Pedal System." This application is a continuation-in-part of U.S. patent application Ser. No. 15/409,428 to Sikra, filed on Jan. 18, 2017 and entitled "Percussion Pedal System," which claims the priority benefit of U.S. Provisional Pat. App. No. 62/281089 to Sikra, filed on Jan. 20, 2016 and entitled "Percussion Pedal System." Each of these applications is fully incorporated by reference herein in its entirety.

BACKGROUND OF THE DISCLOSURE

Field of the Disclosure

Aspects of the present disclosure generally relate to percussive instruments, and more specifically, the present disclosure relates to a percussion pedal system.

Description of the Related Art

Musical notes have been created using many forms of instruments and devices. Percussion instruments, i.e., those that generate sound by being beaten, rattled, and/or vibrated, are sometimes considered to be the oldest type of musical instrument. There are many types of percussion instruments; the drum is considered a classic example of a percussive instrument.

A drum may be sounded by striking some portion of the drum with the hand. Some drums may also generate different tonal sounds when struck with a beater, mallet, or stick. Some musical genres utilize various different percussive sounds and tones to evoke different feelings in the listener; as such, different types of beaters, as well as the drummer's hand, may be used to produce various tones from a given drum.

Depending on the type of music being played, different tonal qualities of an instrument may be more desirable. For example, a flamenco style piece may emphasize different tonalities and tonal relationships between notes than a jazz style of music. Some musical pieces employ different consonance (relaxation and/or harmonization) and dissonance (tension and/or conflict) between the tonic (the central note of a chord or piece of music) and the other notes in a musical composition. As such, different beaters, or hand-beater combinations, may be desirable for some drums.

Some drums use foot-operated devices, sometimes referred to as "drum pedals" or "drum pedal assemblies" to operate and/or control a beater (also referred to as a "mallet" herein) that strikes a drum. The drum pedal may be operated in conjunction with the drummer's hand, such that the drum can be played with the hand to create one tone and the drum pedal/beater to create another tone, without the drummer removing and replacing the beater in their hand. Such an arrangement allows for faster playing as well as allowing the drummer to play more complicated/technical pieces.

Variations in drummer technique mean that it is very difficult to design a single system to meet the needs of every drummer and playing style. Such variables can include drummer playing style and the areas of a drum where the drummer typically strikes with the hand or beater. Hand/beater combination play is often used with a cajón—a percussion instrument that is typically a hollow box shape. Examples of cajóns are described and shown, for example, in commonly assigned U.S. Pat. No. 9,087,497 to Krol et al. and U.S. Des. patent application Ser. No. 29/552,167 to Chandontrikit, each of which is fully incorporated by reference herein in its entirety. One specific example of a cajón and pedal system designed to allow for cajón play with both a hand and a beater is described in commonly assigned U.S. Pat. No. 7,365,258 to Lombardi, which is fully incorporated by reference herein in its entirety.

Adjustable pedals can provide the customization necessary to achieve some or all of a drummer's desired pedal characteristics as well as placing the beater in a location that will produce desired tonal characteristics from the drum without interfering with the drummer's hands beating the drum. Some pedals with adjustable features are described in U.S. Pat. Nos. 5,301,592 and 8,455,746 to Johnston, U.S. Pat. No. 6,590,147 to Kassabian, and U.S. Pat. Pub. No. 2015/0082968 to Sikra, each of which is fully incorporated by reference herein in its entirety.

Adjustment mechanisms provided in the related art can be unwieldy, which can increase difficulty to the user, and/or can lack adjustability of a variable which is independent of other variables, thus reducing the amount of customization available via adjustments. Further, many related art systems merely adapt a drum pedal designed for one type of drum to another, which may not provide a drummer with proper placement of the beater/mallet to play in a comfortable manner. This can lead to diminished performance and/or injury/uncomfortableness to the drummer.

SUMMARY OF THE DISCLOSURE

Some embodiments of the present disclosure are directed toward percussion beater systems and components thereof, where the pedal portion and the beater portion are distal from one another and separated by a connector, such as a cable, that allows actuation of the pedal to cause movement of at least a portion of the beater portion.

One embodiment of a percussion beater system according to the present disclosure includes a pedal portion having a drum pedal and a beater portion having a beater rod holder. A connecting portion including a flexible linking member connects the drum pedal portion and the beater portion such that actuation of the drum pedal causes movement of the beater rod holder.

One embodiment of a drum pedal assembly according to the present disclosure includes a base plate and a pedal on the base plate, a drive shaft on a front portion of the base plate, an arm between the drive shaft and an underside of the pedal, and a roller between the arm and the pedal underside.

One embodiment of a beater assembly according to the present disclosure includes a body and a beater rod holder, and a drive shaft between the two. A connector is operably linked to the drive shaft such that movement of the connector causes rotation of the drive shaft.

One embodiment of a percussion pedal assembly according to the present disclosure includes a base with a pedal on the base, and first and second drive shafts on the base and in front of and behind the pedal, respectively. The assembly further includes a rigid link rod connecting the first and second drive shafts.

One embodiment of a joint piece for use in a direct drive percussion system includes an elongated main body with a first end defining a first aperture and a second end defining a second aperture. A first post is in the first aperture and a second post is in the second aperture, and the distance by which the first and second posts extend from their respective apertures is adjustable.

The above summary has outlined, rather broadly, some features and technical advantages of the present disclosure in order that the detailed description that follows may be better understood. Additional features and advantages of the disclosure will be described below. It should be appreciated by those skilled in the art that this disclosure may be readily utilized as a basis for modifying or designing other structures for carrying out the same or similar purposes of the present disclosure. It should also be realized by those skilled in the art that such equivalent constructions do not depart from the teachings of the disclosure as set forth in the appended claims. The novel features, which are believed to be characteristic of the disclosure, both as to its organization and method of operation, together with further objects and advantages, will be better understood from the following description when considered in connection with the accompanying figures. It is to be expressly understood, however, that each of the figures is provided for the purpose of illustration and description only and is not intended as a definition of the limits of the present disclosure.

BRIEF DESCRIPTION OF THE DRAWINGS

For a more complete understanding of the present disclosure, reference is now made to the following description taken in conjunction with the accompanying drawings.

DETAILED DESCRIPTION OF THE DISCLOSURE

Overview

Figure 1:
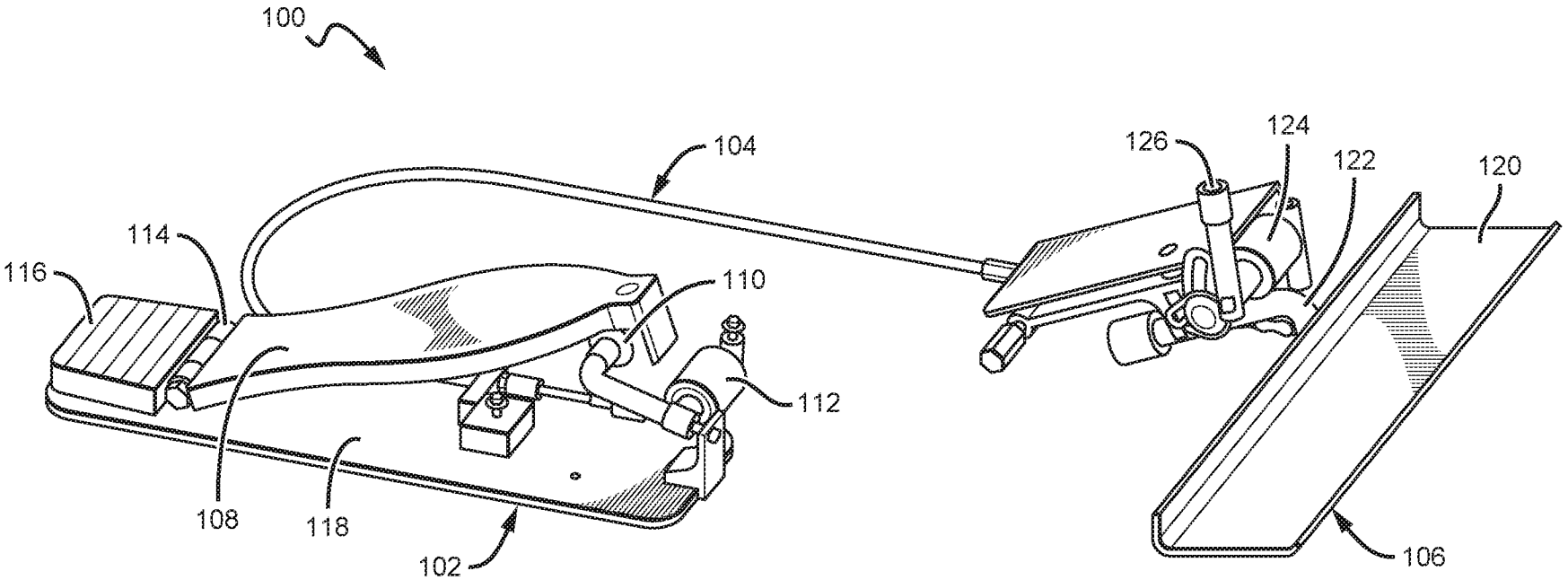
FIG. 1 illustrates one embodiment of a percussion pedal system in accordance with an aspect of the present disclosure.

Music, and musical compositions such as songs, are often written and/or composed to evoke emotions and/or feelings in the listener. Musical presentations combine tones and harmonics (also known as "overtones") to tell a story. Many different types of musical instruments, e.g., stringed instruments, percussive instruments, wind instruments, etc., may be used, alone or in combination, to present an artist's interpretation of a feeling and/or emotion through auditory stimuli.

The underlying tonality, rhythm, and/or "beat" of a piece of music are often provided by percussion instruments, e.g., drums. The tonal qualities of a particular type of drum, referred to as a "cojón," is prevalent in flamenco, jazz, Cuban rumba, and Peruvian music. Although discussed herein with respect to a cojón, the system described herein may be used with other percussive instruments without departing from the scope of the present disclosure.

A cajón is nominally a six-sided, box-shaped instrument, where the drummer or player sits on top of the cajón and slaps the front face, rear face, and/or sides of the instrument with the palms or fingers. The faces of the cajón may also be struck with a stick, beater, mallet, brush, or other implement to create a different sound or generate a faster beat than can be accomplished with just the hands.

Since the player is often sitting on top of the cajón, using a bass drum pedal may be difficult as the pedal for a bass drum is designed to point away from the player. As such, use of a typical bass drum pedal when playing a cajón creates an awkward playing position. Further, because the bass drum pedal is designed to strike the bass drum at approximately the same height as the cajón player's hands, the use of a bass drum pedal to play the cajón in addition to hand/finger playing often restricts some form of playing the instrument.

The detailed description set forth herein, in connection with the appended drawings, is intended as a description of various configurations and is not intended to represent the only configurations in which the concepts described herein may be practiced. The detailed description includes specific details for the purpose of providing a thorough understanding of the various concepts. It will be apparent, however, to those reasonably skilled in the art that these concepts may be practiced without these specific details. In some instances, structures and components are shown in block diagram form in order to aid in avoiding obscuring such concepts.

It is understood that when an element is referred to as being "on," "attached to," "connected to," or similar to another element, it can be directly on the other element or intervening elements may also be present. Further, when one element is referred to as being "connected" to another element, it can be directly connected to the other element or intervening elements may also be present as would be understood by one of skill in the art. Furthermore, relative terms such as "inner", "outer", "upper", "top", "above", "lower", "bottom", "beneath", "below", and similar terms, may be used herein to describe a relationship of one element to another. Terms such as "higher", "lower", "wider", "narrower", and similar terms, may be used herein to describe angular and/or relative relationships. It is understood that these terms are intended to encompass different orientations of the elements or system in addition to the orientation depicted in the figures.

Although the terms first, second, etc., may be used herein to describe various elements, components, regions and/or sections, these elements, components, regions, and/or sections should not be limited by these terms. These terms are only used to distinguish one element, component, region, or section from another. Thus, unless expressly stated otherwise, a first element, component, region, or section discussed below could be termed a second element, component, region, or section without departing from the teachings of the present disclosure.

Embodiments of the disclosure are described herein with reference to view illustrations that are schematic illustrations. As such, the actual thickness of elements can be different, and variations from the shapes of the illustrations as a result, for example, of manufacturing techniques and/or tolerances are expected. Thus, the elements illustrated in the figures are schematic in nature and their shapes are not intended to illustrate the precise shape of a region and are not intended to limit the scope of the disclosure.

System Diagram

FIG. 1 illustrates one embodiment of a percussion pedal system according to the present disclosure.

System 100 comprises a pedal portion 102, a connecting portion 104, and a beater portion 106. The pedal portion 102 may be positioned at a comfortable and/or customizable location for the user's foot, while beater portion 106 is positioned proximate to a drum or other percussive instrument. The connecting portion 104 is flexible and/or moveable with respect to pedal portion 102 and beater portion 106, such that the relative placements of pedal portion 102 and beater portion 106 may be varied and/or changed.

Pedal portion 102 can include a pedal 108, roller 110, and drive shaft 112. Pedal 108 may include a hinge 114 and optionally comprises a heel plate 116. As pedal 108 is pressed, pedal 108 rotates about an axis of hinge 114. Pressing on pedal 108 also moves the opposite end of pedal 108 toward a base 118 of pedal portion 102, which engages roller 110. Roller 110 moves along a bottom surface of pedal 108 (e.g., a surface opposite where a user's foot may engage pedal 108), and rotates or otherwise engages a drive shaft 112. As drive shaft 112 rotates, connecting portion 104 is engaged and moved. Roller 110 may ride in a groove on pedal 108, a raised portion of pedal 108, or on any surface of pedal 108 to provide a specific feel and/or playing action to a drummer. Drive shaft 112 may also be coupled closer to hinge 114, or adjustable with respect to the distance between drive shaft 112 and hinge 114, to customize the height of pedal 108 when at a resting position.

Roller 110 provides a smooth movement of drive shaft 112. Such smooth movement of roller 110 on pedal 108 provides a better "feel" or "playing action" to a drummer playing a drum when employing system 100. The diameter of roller 110 may be selected to provide a large movement of drive shaft 112 with a small movement of pedal 108, or may be selected to provide a linear movement of drive shaft 112 with movement of pedal 108. In one embodiment of the present disclosure, the roller has a diameter of between about 0.25 inch and 2 inches, and/or between about 0.5 inch and 1 inch, and/or about 0.75 inch, all inclusive. Many possible relative movements of drive shaft 112 with respect to movement of pedal 108 are possible within the scope of the present disclosure. Further, roller 110 may have a cam or elliptical, oval, or other non-circular shape, and the primary axis of roller 110 may be adjusted with respect to a resting position of pedal 108 to customize the motion of pedal 108 in generating motion in the beater portion 106.

As drive shaft 112 moves, connecting portion 104, which may be a cable such as a sheathed cable, also moves. For example, and not by way of limitation, drive shaft 112 may rotate and pull a cable (part of connecting portion 104) that is coupled to beater portion 106, which then can move a part within beater portion 106. Connecting portion 104 may be a linkage, a push-rod mechanical connector, or other actuator and/or device to translate motion in the beater portion 106. While the embodiment shown in FIG. 1 and those described below refer to a "cable," it is understood that any linking member may be used, such as a rope, wire, chain, rigid device, etc.

Beater portion 106 can include a bracket 120, a rod 122, a drive shaft 124, and a beater rod holder 126. At least a portion of bracket 120 may be placed under a drum and/or cajón to position and/or hold beater portion 106 in proximity to a drum and/or cajón. Bracket 120 may be shaped to accommodate various different shapes of drums, e.g., round, square, crescent shaped, partially crescent shaped, etc., without departing from the scope of the present disclosure. Further, some embodiments of the present disclosure do not include a bracket.

Rod 122 can be coupled to bracket 120, and may comprise a standard diameter rod used in percussive instrument design and/or manufacture if desired. For example, and not by way of limitation, rod 122 may be a ½ inch diameter rod, such that readily available mounting hardware may be used to couple drive shaft 124 to rod 122.

Beater portion 106 is coupled to connecting portion 104 such that drive shaft 124 motion (e.g., rotation) is initiated by motion of pedal 108. Motion of pedal 108, which may be created by pressure of a drummer's foot, is transferred through connecting portion 104 to drive shaft 124. As drive shaft 124 is moved by connecting portion 104 (vis-à-vis pedal 108 and drive shaft 112), drive shaft 124 transfers movement to beater rod holder 126. Beater rod holder 126 is configured to accept a beater (and/or mallet) for use in striking a drum and/or cajón.

Pedal Portion

Figure 2:
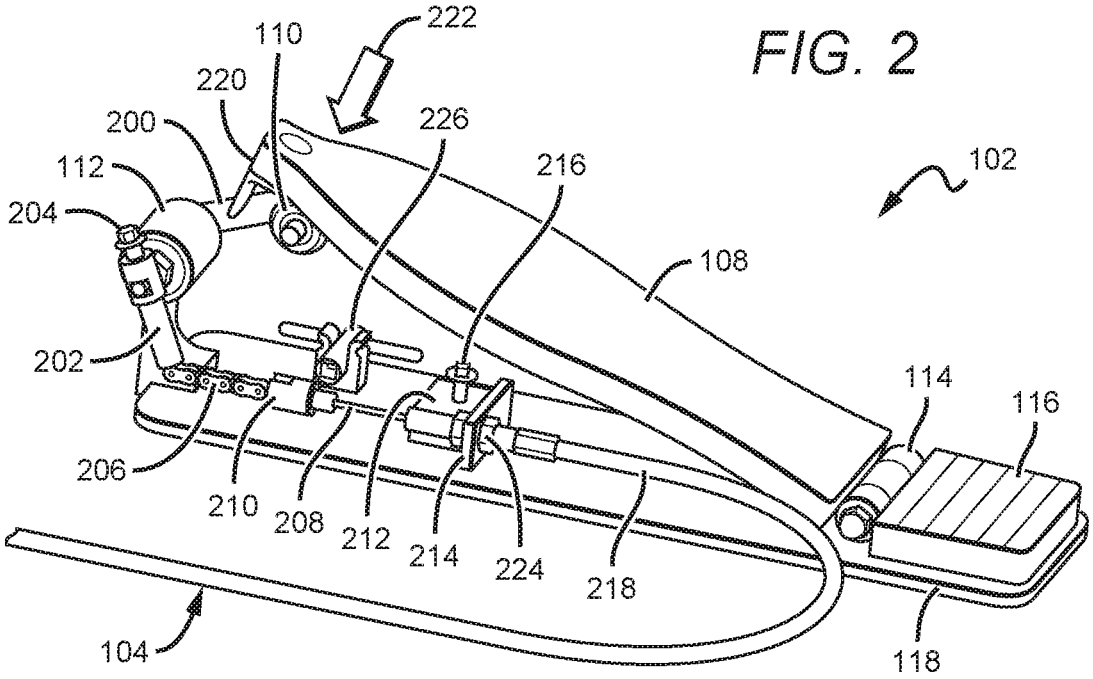
FIG. 2 illustrates one embodiment of a pedal portion of a system in accordance with an aspect of the present disclosure.

FIG. 2 illustrates a pedal portion 102 of a system in accordance with an aspect of the present disclosure. It is understood that many other pedal portions can be used as part of systems according to the present disclosures, such as pedals and components described in commonly assigned U.S. Pat. Pub. No. 2015/0082968 to Sikra, which is fully incorporated by reference herein in its entirety.

In an aspect of the present disclosure, pedal portion 102 may also comprise a roller arm 200 (or other style of arm or connection), which couples roller 110 to drive shaft 112. Drive shaft 112 is coupled to arm 202, and is secured to arm 202 with nut 204. Arm 202 is also coupled to chain 206 or another type of connector which may be rigid, flexible (e.g. rope, strap, etc.), or otherwise, which then couples to cable 208 at connector 210. It is understood that cable 208 may connect directly to arm 202 and/or drive shaft 112 without use of chain 206. Cable 208 can pass through a housing 212, which is coupled to plate 214 by nut 216. After passing through housing 212, cable 208 can enter a housing or sheath 218 which may be part of connecting portion 104, although the housing/sheath 218 is not strictly necessary (but has the benefit of providing environmental protection to cable 208). Pedal 108 may optionally comprise a stop 220 to stop roller 110 from disengaging from pedal 108 and/or to set a maximum actuation position of pedal 108.

In an aspect of the present disclosure, pedal portion 102 may be operated by depressing pedal 108 in direction 222. Pressure on pedal 108 in direction 222 moves roller along pedal 102 towards hinge 114, which moves roller arm 200 that is attached to roller 110. As roller arm 200 moves, drive shaft 112 is rotated, which rotates arm 202. The rotation of arm 202, which is a clockwise rotation in the perspective of FIG. 2, pulls chain 206 away from hinge 114. This motion of chain 206 also moves cable 208. The other end of cable 208 is coupled to beater portion 106, which will be described herein below.

In an aspect of the present disclosure, the engagement of drive shaft 112 may be adjusted by adjusting one or more nuts 224 coupled to housing 212. As the nut 224 is moved with respect to plate 214, the relative tension on cable 208 may be adjusted, thereby adjusting where in the motion along direction 222 that drive shaft 112 is engaged. Similarly, the relative angles of coupling between roller arm 200 and drive shaft 112, and/or the coupling angle between arm 202 and drive shaft 112, may also affect the engagement point of pedal 108 with respect to movement of cable 208. These angles can be also be adjusted such as (for the arm 202, though the same or similar system can apply to arm 200) loosening nut 204, adjusting the angle of arm 202 relative to drive shaft 112, and retightening nut 204. Further, the length of chain 206, size of roller 110, length of roller arm 200 (i.e., between roller 110 and drive shaft 112) may also be adjusted to change the engagement point of pedal 108 in terms of motion of cable 208.

The adjustment of the engagement point of pedal 108 is important to drummers, in that different engagement points will raise or lower the height of pedal 108 with respect to base 118. In such adjustments, the angle that a drummer's ankle must take to have the pedal 108 not move cable 208 (and thus not move the beater rod holder 126) can be varied, as well as the amount of movement of pedal 108 that must be undertaken in direction 222 to produce sound from a drum coupled to beater portion 106. These adjustments allow for customization of the system 100 to each individual drummer, as well as different types of drums, without producing several different types of systems 100.

Connecting portion 104 may be removed from pedal portion 102 by loosening nut 216, and removing plate 214 from base 118. In an aspect of the present disclosure, multiple nuts 224 may be used to maintain the tension of cable 208 with respect to arm 202. Nuts 204 and 216, as well as other nuts used in the system 100, may be standardized if desired with respect to other hardware employed in drum/percussion instruments. As such, a wrench 226 may be mounted in a clip or otherwise attached to base 118, or elsewhere in system 100, for ease of disassembly of pedal portion 102 from connecting portion 104. The connection between plate 214 and housing 212 can include any type of connection in the art. In one embodiment a magnetic connection and/or a male/female connection are used.

The advantage of disassembly within system 100, in an aspect of the present disclosure, allows for easier portability of system 100, and also allows for installation of one or more portions of system 100 in specific locations. For example, and not by way of limitation, pedal portion 102 may be mounted on a plate, beater portion 106 may be mounted on a drum, etc., and the system 100 can still be assembled and/or disassembled in a relatively quick and easy fashion. Further, one portion of system 100 is not tethered to the other portion(s) permanently, and thus can be interchanged with other embodiments of system components if desired. For example, the beater portion 106, connecting portion 104 can be disconnected from the pedal portion 102 by loosening and removing plate 214 and arm 202, or by other methods. Not by way of limitation, a beater portion 106 of one system may be used with a pedal portion 102 of another system without departing from the scope of the present disclosure.

Beater Portion

Figure 3:
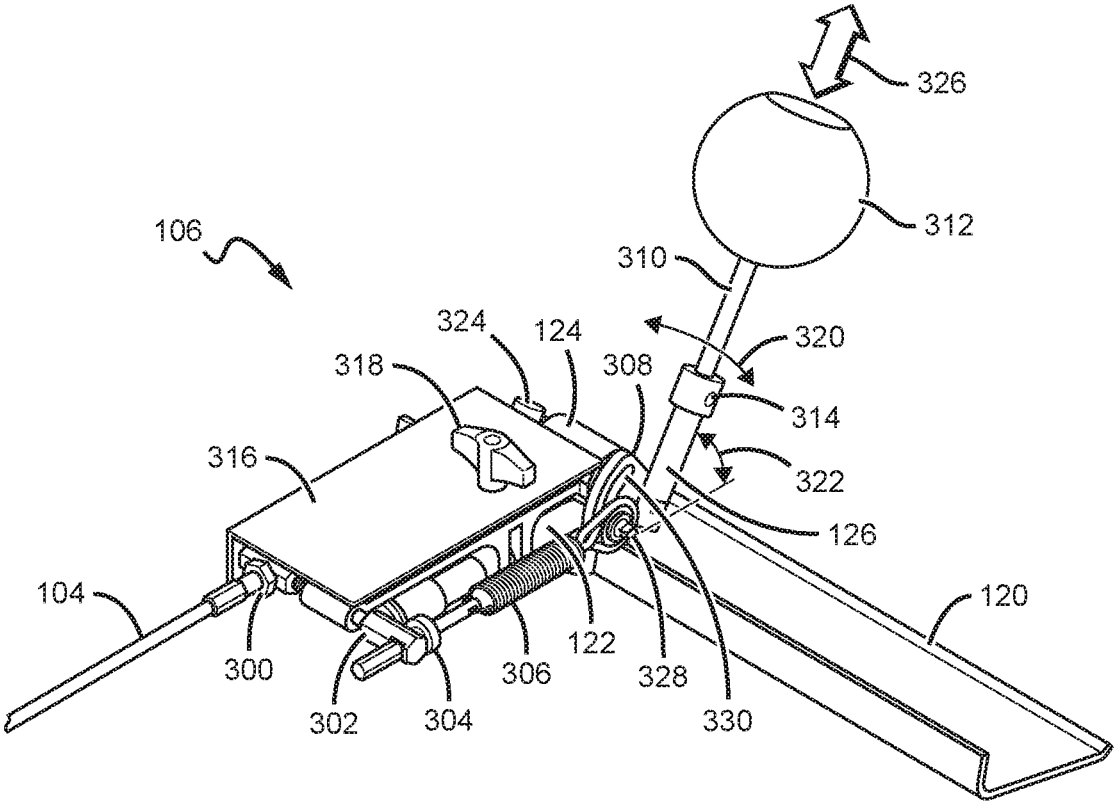
FIG. 3 illustrates one embodiment of a beater portion of a system in accordance with an aspect of the present disclosure.

FIG. 3 illustrates a beater portion of a system in an aspect of the present disclosure.

As shown in FIG. 3, beater portion 106 is coupled to connecting portion 104 at connector 300. Cable 208, or another motion-transferring device, can couple pedal portion 102 through connecting portion 104 to beater portion 106 as described with respect to FIGS. 1 and 2. Connector 300, or some other part within beater portion 106, may provide an additional disconnection point within system 100 as desired, as described with respect to FIG. 2 above.

Connecting portion 104, via connector 300, is coupled to drive shaft 124 in a similar manner as shown in FIG. 2, e.g., chain, cable, connector, etc., although other methods of connection to transfer motion are possible without departing from the scope of the present disclosure.

Shaft 302 is further coupled to pin 304. Pin 304 is coupled to spring 306, and spring 306 is coupled to cam 308. Cam 308 is coupled to beater rod holder 126. As cable 208 is moved within connecting portion 104, drive shaft 124 rotates, which pulls and/or pushes on beater rod holder 126. As beater rod holder 126 rotates, a beater coupled to beater rod holder 126 will strike a surface, e.g., the surface of a percussive instrument.

To control the strength and/or backswing of beater rod holder 126, cam 308 rotates, which pulls and/or pushes on spring 306. The position of pin 304 may be adjusted to control the tension on spring 306, which will control the amount of reverse tension on beater rod holder 126. Additionally, the resting position of the connection between the spring 306 and the cam 308, such as the position of the pin 328, can be adjusted. For example, the position of the pin 328 or other connector can be adjusted within an aperture 330 of the cam 308, thus adjusting the resting angle of the beater rod holder 126. Similar adjustment devices which can be used in embodiments of the present disclosure are described in commonly assigned U.S. Pat. Pub. No. 2015/0082968 to Sikra and U.S. Pat. App. No. 62/281,089 to Sikra, each of which is fully incorporated by reference herein in its entirety.

Beater rod 310 is coupled to a beater head 312, and beater rod 310 may be inserted in beater rod holder 126. A nut 314 is attached to beater rod holder 126 such that the height 326 of the beater head 312 with respect to bracket 120 may be adjusted. Beater rod holder 126 and the rotational axis of cam 308 are positioned to have a low rotational axis (also referred to as a "fulcrum point" herein), which is somewhat different than the typical rotational axis/fulcrum point of a drum pedal used for a bass drum.

For example, and not by way of limitation, the rotational axis of beater rod holder 126 may be between about 0.5 inch and 6 inches from floor, and/or between about 0.5 inch and 4 inches from the floor, and/or between about 1 inch and 3 inches from the floor, and/or about 2 inches from the floor, and/or less than 4 inches from the floor, and/or less than 3 inches from the floor (which may be the same plane as a bottom of the system 100, and/or the same plane as a bottom surface of bracket 120, or the bottom plane of beater portion 106), while the rotational axis of a beater rod holder in a bass drum pedal may be seven inches from the floor. Because system 100 may be used with different types of drums, e.g., a cajón, and such drums have different locations to strike to produce a desired sound, a desired location of the rotational axis of beater rod holder may be lower to the floor, as illustrated and described with respect to FIG. 3. However, the rotational axis location may still be adjusted within system 100, such as by changing a height attachment between body 316 and rod 122.

Further, a low fulcrum point, which, in an aspect of the present disclosure, may also be the rotational axis of drive shaft 124, allows for a different contact point with a drum surface than a typical natural contact point for a drummer's hands or other beaters. For example, and not by way of limitation, beater head 312, as configured with system 100, may be arranged to strike the face of a cajón at a specific point, while the drummer's hands strike the face of the cajón at a height above the contact point of the beater head 312. As such, the beater head 312 does not interfere with the drummer's hands, and the drummer can thus produce specific beats, sounds, and tones from the cajón without changing the specific preferred playing style that particular drummer employs.

Nut 314 may also adjust the attachment point between beater rod holder 126 and beater rod 310, which adjusts the height 326 and/or the location of beater head 312 with respect to the surface to be struck. By changing the distance between shaft 302 and cam 308, a larger moment arm is created, which changes the relative speed of beater head 312 with respect to a surface to be struck. As such, the amount of movement of pedal 108 employed to strike a surface with beater head 312 may be customized by changing the tension on spring 306 and/or the attachment point between beater rod 310 and beater rod holder 126 and/or the angle of the beater rod holder 126 as previously described.

In an aspect of the present disclosure, rotational control 318 controls the angle at which body 316 is coupled to rod 122. By loosening rotational control 318, which may be a threaded coupling between body 316 and rod 122, the entire body of beater portion 106 may be rotated through angle 320 with respect to bracket 120. This control allows for rotation of the beater rod holder 126, and thus, rotation of the beater head 312, with respect to the surface to be struck by beater head 312. Such rotational control gives additional clearance or adjustment between the locations where the beater head 312 strikes a surface with respect to locations where a drummer's hands or other beaters may strike the same surface. Further, minor changes in rotation via rotational control 318 may provide tuning of the drum, e.g., cajón, by changing the location where the beater head 312 strikes the cajón. Rotational control 318 may be loosened and/or tightened to fix a specific angle between beater portion 106 and a particular drum, and then repositioned to fix a different angle between beater portion 106 and another drum, further expanding the customizable features of system 100 of the present disclosure. Rotational control 318 may also control the distance between beater head 312 and the surface to be struck, as rotational control 318 may also move the connection point between body 316 and rod 122. This movement between body 316 (and thus beater head 312) may change the angle at which the beater head 312 strikes the surface of the drum, further changing the tones produced.

For example, and not by way of limitation, when placed at a first location on rod 122, the beater head 312 may strike the surface of the drum when the beater rod 310 is at a 90 degree angle as measured with respect to the floor. When rotational control 318 is loosened and body 316 is moved farther away from the surface of the drum to be struck, the beater head may strike the surface at an angle of over 90 degrees, such as shown in FIG. 3 as angle 322. Because connecting portion 104 may be coupled to beater portion 106 at or near arm 324 (another point that is coupled to drive shaft 124), the rotation of body 316, as well as the movement toward and/or away from bracket 120, may only minimally not affect the drummer's "feel" of the pedal 108, and/or may only minimally affect the tonal qualities of the percussive strike of beater head 312, other than those qualities that are selected to be altered by a particular drummer when setting up system 100 for a given drum.

Cajón System Interfacing

Figure 5:
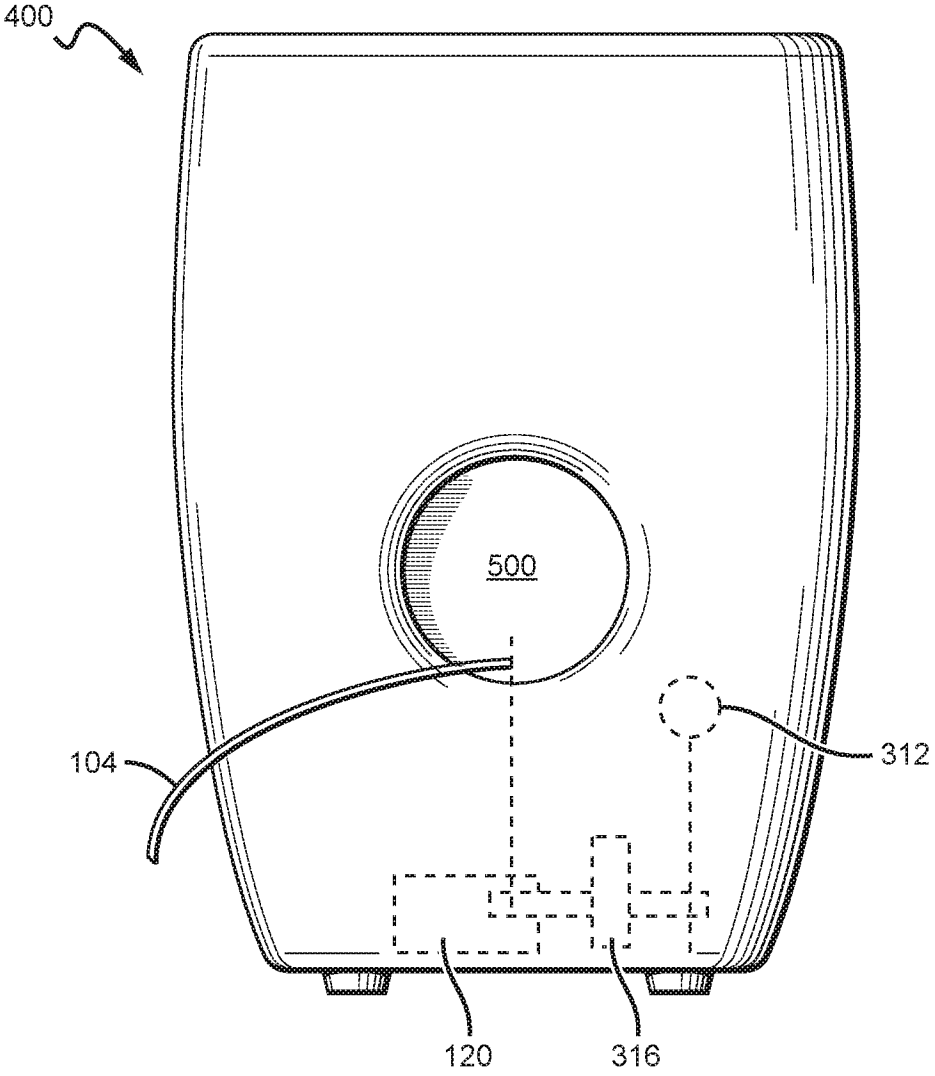
FIGS. 4 and 5 illustrate one embodiment of a drum which may be employed in accordance with various aspects of the present disclosure.
Figure 4:
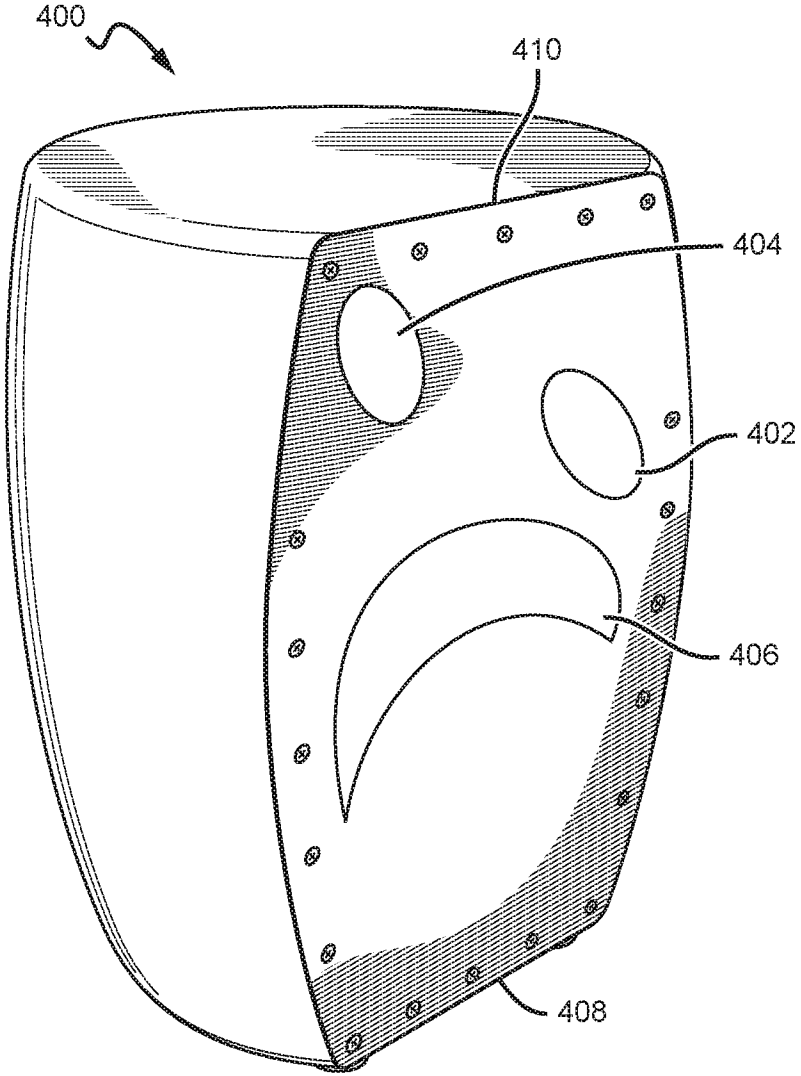

FIGS. 4-5 illustrate a drum which may be employed in accordance with various aspects of the present disclosure.

FIG. 4 illustrates a perspective view of a cajón 400. A cajón may be played by sitting on the top (shown at the top of FIG. 4) of cajón 400, and slapping the face(s) of cajón 400 with a user's hands. A particular user may slap the face of cajón 400 with their left hand in area 402, and with their right hand in area 404, as those areas may produce different tonal qualities from cajón 400. However, bracket 120 of system 100 of the present disclosure may be placed under cajón 400 at edge 408, and the player may adjust system 100 of the present disclosure to strike cajón 400 anywhere within area 406 (such as by adjusting via the previously described rotational control along the direction 320), such that a beater may produce different tonal qualities than hand slapping in areas 402 and 404 and/or may strike the cajón 400 in areas relatively distal from the natural striking area of the hands.

The sizes and/or areas described with respect to areas 402-406 are not to be considered limiting; as described herein, system 100 of the present disclosure may be customized and/or adjusted to strike cajón 400, or any percussive instrument, in any fashion without departing from the scope of the present disclosure. For example, and not by way of limitation, a bracket 120 may be used to attach system 100 to edge 410 of cajón 400, and movement of pedal 108 may then cause beater head 312 to strike cajón 400 in a different area, from the top rather than the bottom of cajón 400, or may be attached to cajón 400 on a side or the curved face of cajón 400, without departing from the scope of the present disclosure.

FIG. 5 illustrates a cajón in accordance with another aspect of the present disclosure.

Cajón 400 comprises a sound hole 500 which allows the reverberations of the hand/beater strike of cajón 400 to be heard by the audience, other musicians, and/or the drummer. In an aspect of the present disclosure, system 100 may be partially mounted within cajón 400, such that beater head 312 strikes the inside surface of cajón 400 rather than the surface being struck by the drummer. Since bracket 120, body 316, beater head 312, and other portions of system 100 may be inside of cajón 400 (or other percussive instrument), these portions of system 100 are shown in phantom lines in FIG. 5. In one embodiment, a bracket such as the bracket 120 is not included, which can allow for easier placement of the beater portion 106 within the cajón 400.

Because beater portion 106 may be removed from pedal portion 102, connecting portion may be sized to allow for mounting bracket 120 on a bottom, side, and/or any surface of cajón 400, such that beater head 312 can strike any surface of cajón 400. Further, since rotational control 318 allows for movement of body 316, the beater portion 106 may be easily moved, positioned, and/or removed from cajón 400 and mounted to a separate bracket 120 for use with another drum and/or cajón 400. Beater portion 106 may also be sized to fit in cajón 400, such that the parts of beater portion 106 fit inside sound hole 500 and can be mounted within cajón 400 without departing from the scope of the present disclosure.

Because rotational control 318 allows body 316 to be removed from rod 122, body 316 may be mounted on other rods that are used with drums and/or other percussive instruments. For instance, in one embodiment the beater portion 106 may be used with a cajón that includes an internal rod, such as an L-rod, that can be similar to rod 122, but mounted within the cajón and/or as part of the cajón in an area so as to enable mounting and actuation of the cajón inside surface. Thus, the body 316 can be removed from bracket 120 and rod 122 and reattached to the internal cajón rod (or other mount device). As another example, and not by way of limitation, body 316 may be mounted on the leg of a floor tom, or may be mounted on a bracket that is coupled to a tambourine or other cymbal, such that motion of pedal 108 will allow a beater head 312 to strike any percussive instrument. A floor tom, for example, may produce a different sound when being struck by a drum stick than when being struck with a beater head 312, and, as such, the tonal qualities that a drummer can produce with a given drum and/or drum set can be increased and expanded through the use of system 100 in such applications.

Additional System Views

FIGS. 6-9 illustrate additional views of a system in accordance with various aspects of the present disclosure.

Figure 6:
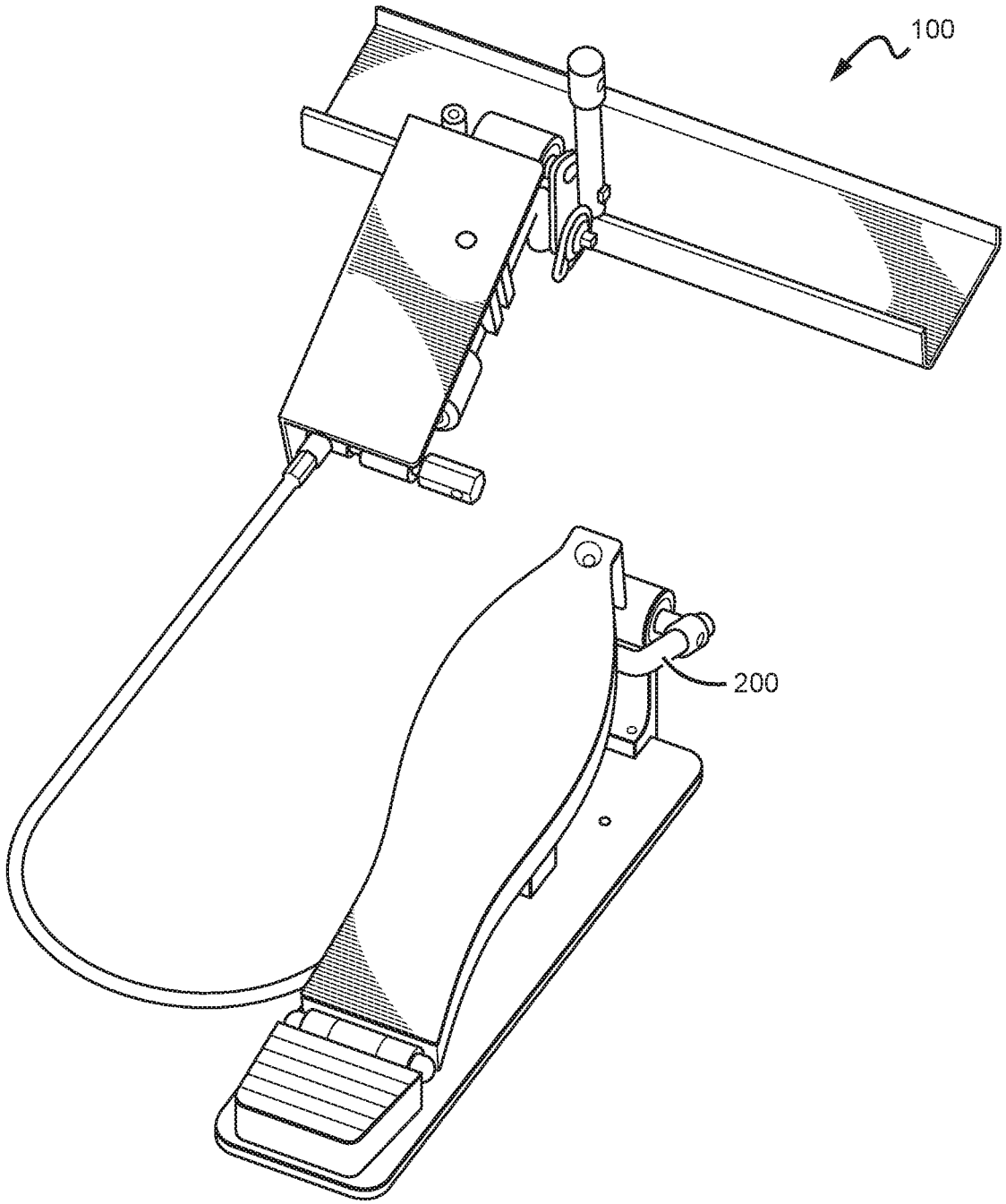
FIGS. 6-9 illustrate additional views of one embodiment of a system in accordance with various aspects of the present disclosure.

FIG. 6 illustrates a top-perspective view of system 100, which also illustrates the effect of longer and/or shorter roller arms 200 on pedal 108 movements.

Figure 7:
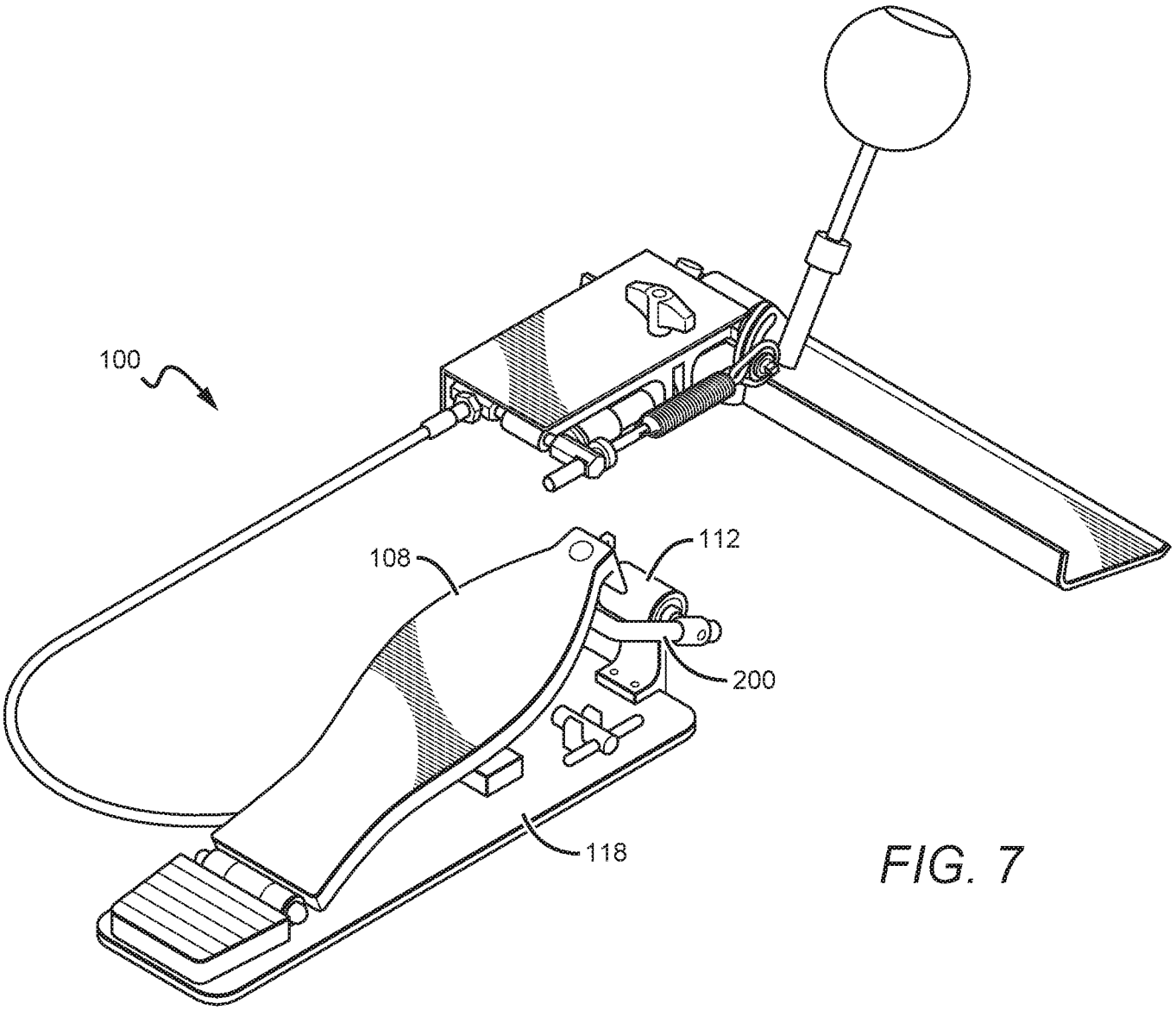

FIG. 7 illustrates a side-perspective view of system 100, which further illustrates the effect of longer and/or shorter roller arms 200 on pedal 108 movements. As roller arm 200 comprises a longer length (i.e., distance between drive shaft 112 and roller 110), roller 110 engages a different portion of pedal 108. For the same diameter roller 110, the height of pedal 108 (i.e., distance between pedal 108 and base 118) will be larger as roller arm 200 becomes longer.

Figure 8:
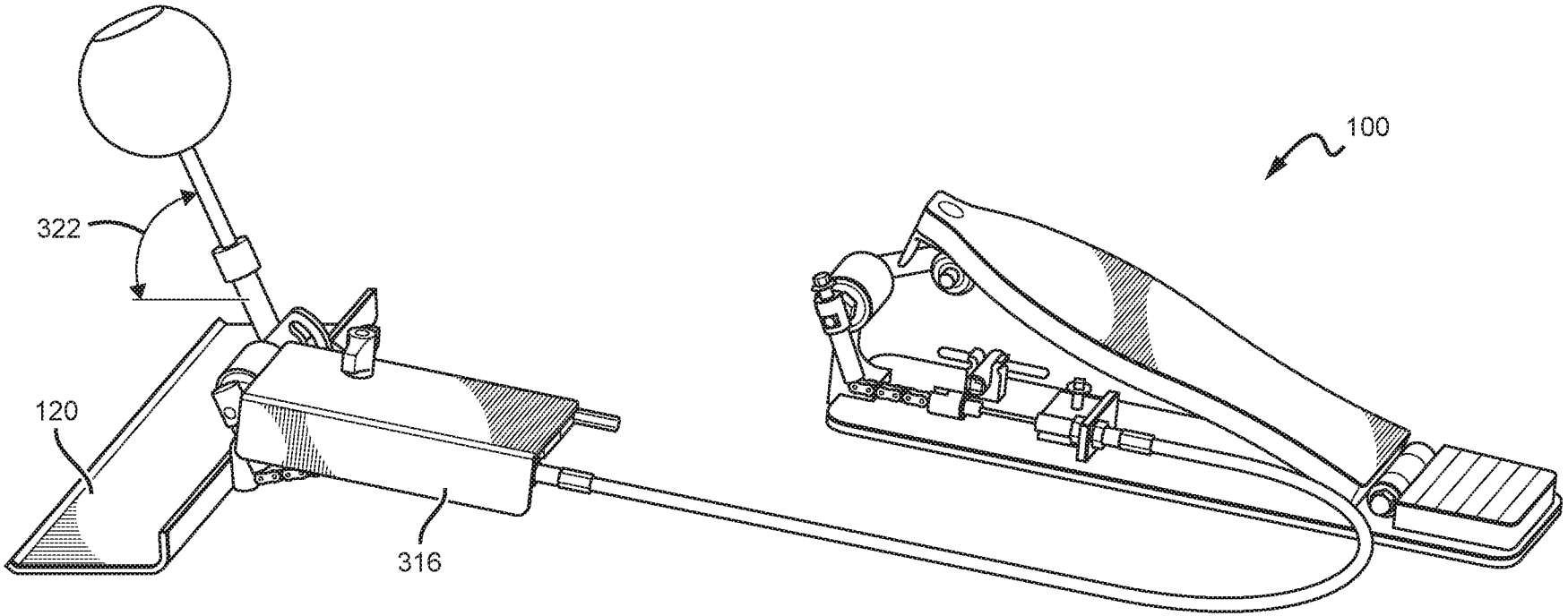

FIG. 8 illustrates a side-perspective view of system 100, which illustrates some angles 322 which can be taken by beater head 312. By adjusting the distance between body 316 and bracket 120, the angle 322 may be changed.

Figure 9:
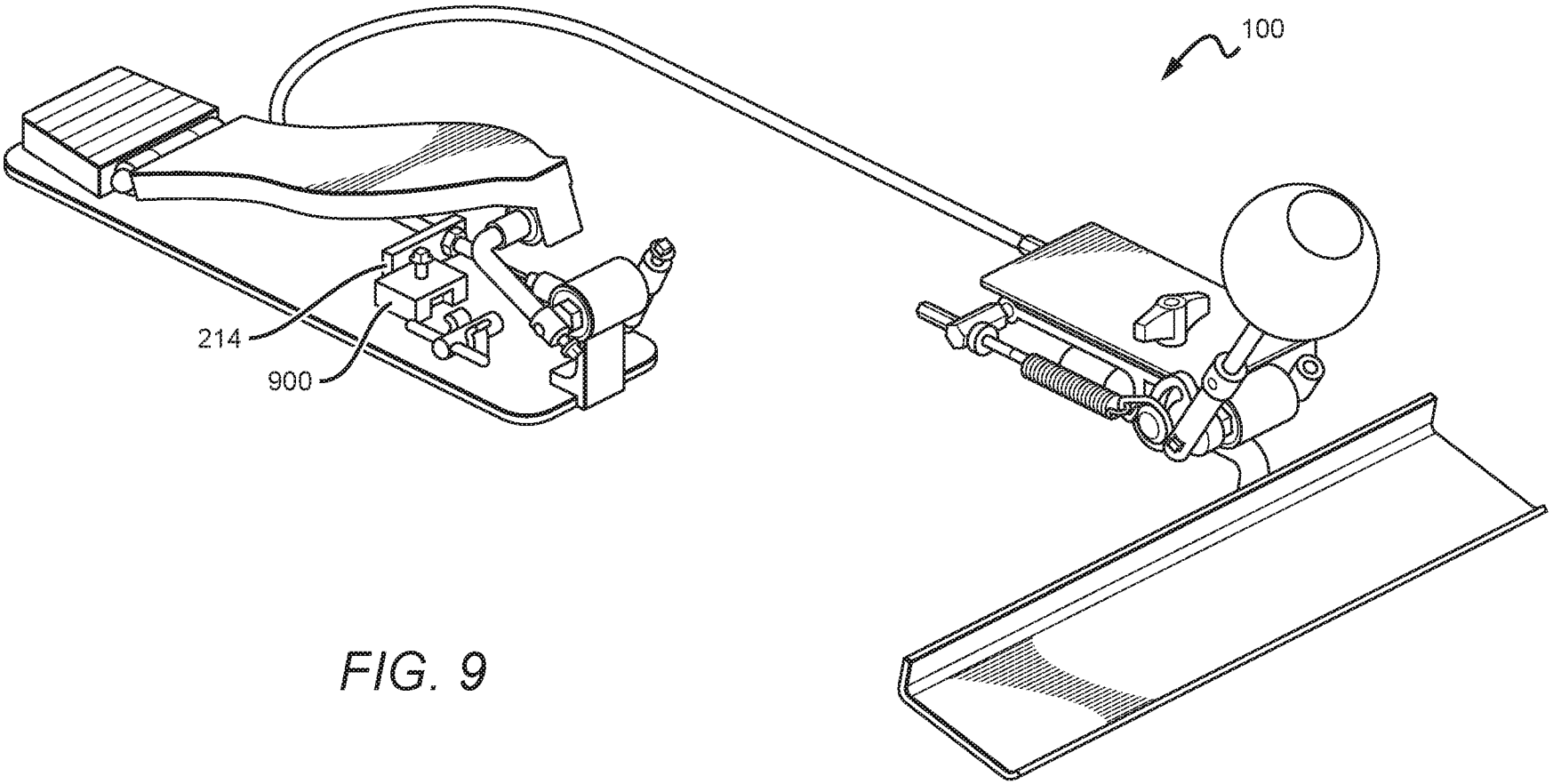

FIG. 9 illustrates a front-perspective view of system 100, which illustrates plate 214 coupling with bracket 900. Bracket 900 may allow for linear motion of plate 214 to allow for further adjustment of the connection between pedal portion 102 and connecting portion 104 in an aspect of the present disclosure. Such a connection between bracket 900 and plate 214 may be a male-female connection, slot-and-tab connection, a spring-loaded pin connection, a magnetic connection, and/or other fixed and/or variable connection that may provide for disconnection between pedal portion 102 and connecting portion 104 without departing from the scope of the present disclosure, and/or may be a combination of any of these types of connections. Similar connections may be provided in other aspects of the present disclosure between connecting portion 104 and beater portion 106.

Inset Views

Figure 10:
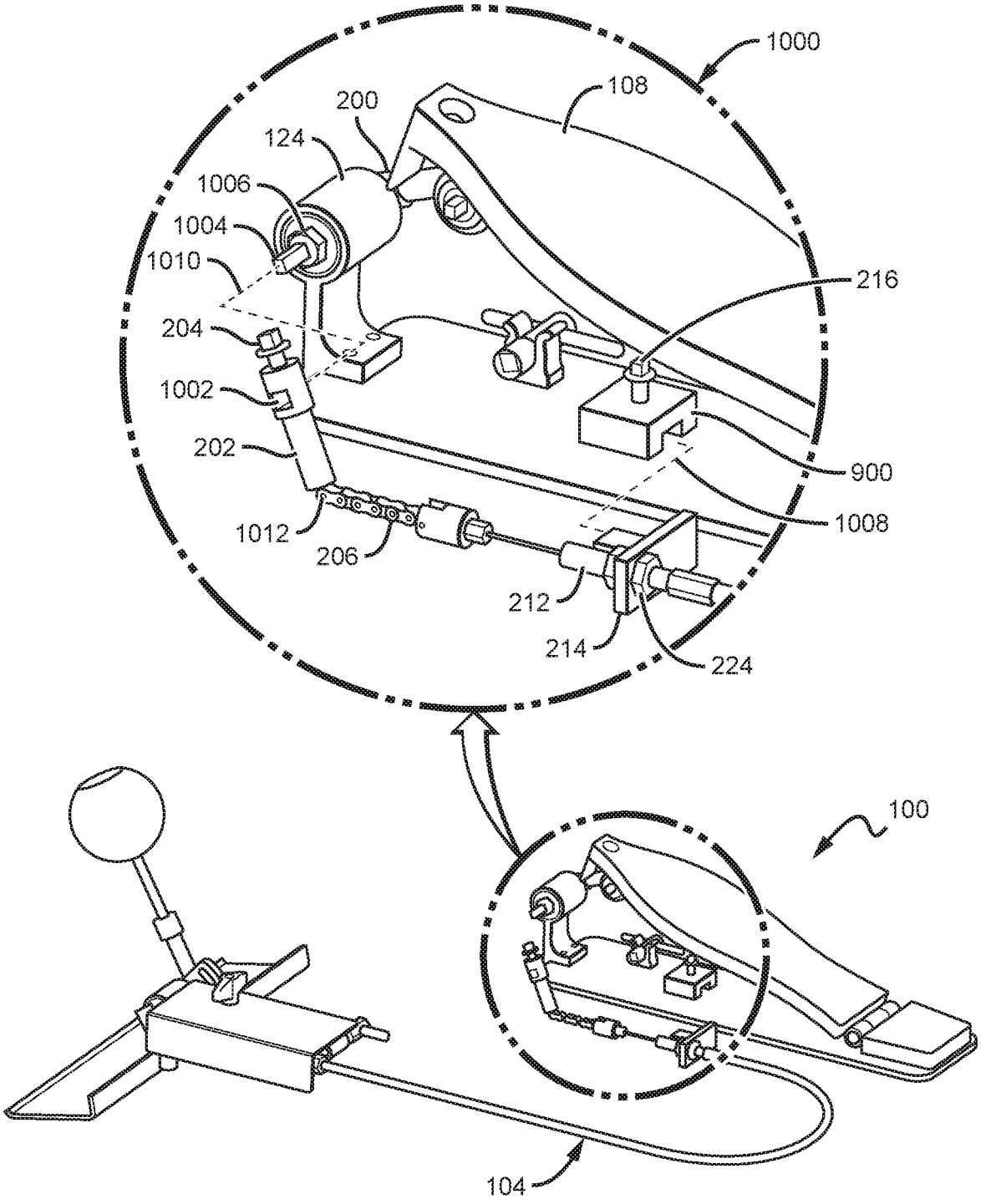
FIGS. 10 and 11 illustrate inset views of one embodiment of a system in accordance with various aspects of the present disclosure.
Figure 11:
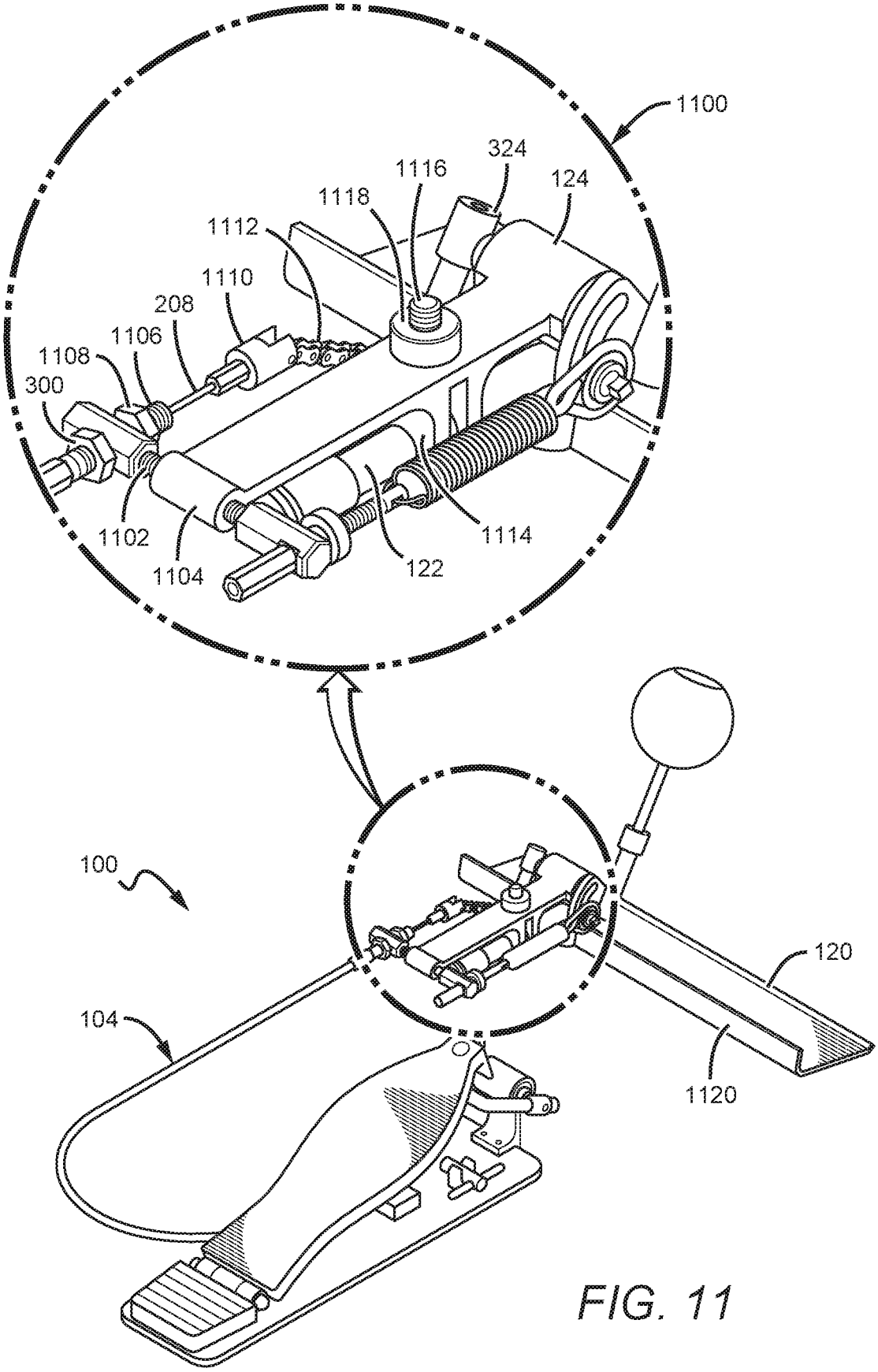

FIGS. 10-11 illustrate inset views of a system in accordance with various aspects of the present disclosure.

FIG. 10 illustrates an inset view 1000 of system 100. As shown in inset view 1000, to disconnect connecting portion 104 from pedal portion 102, nut 216 may be loosened to reduce pressure between bracket 900 and plate 214. In one embodiment nut 216 may be loosened such that the position of plate 214 relative to bracket 900 may be adjusted, and then nut 216 may be tightened so as to lock plate 214 into place relative to bracket 900. Another connection between connecting portion 104 and pedal portion 102 is arm 202, which is coupled to drive shaft 124 at interface 1002. Although interface 1002 is shown as a square mortise through arm 202, other shapes of interfaces, e.g., hexagonal, octagonal, round, elliptical, etc. may be employed without departing from the scope of the present disclosure. Further, nut 204 may or may not be employed to fix arm 202 to drive shaft 124.

Inset 1000 also shows additional details of drive shaft 124. Drive shaft 124 may comprise, for example, shaft 1004 and one or more bearings 1006. Shaft 1004 may be shaped on one end to couple to arm 202, and may have a similar or different shape to couple to roller arm 200.

Dashed line 1008 illustrates the coupling between plate 214 and bracket 900. Dashed line 1010 illustrates the coupling between arm 202 and shaft 1004. Because the distance between arm 202 (where chain 206 couples to arm 202 at point 1012) may be adjusted by nut 224, removing connecting portion 104 as shown in FIG. 10 does not appreciably change any adjustments made by a particular user, since the adjustments are kept appreciably constant as the arm 202 and plate 214 are removed. Although nut 216 may be used to couple bracket 900 and plate 214, other coupling mechanisms, e.g., a spring-loaded detent, a pinned hole in plate 214 and a pin that may be inserted through bracket 900 and plate 214, etc., without departing from the scope of the present disclosure.

FIG. 11 illustrates an inset view 1100 of beater portion 106 in an aspect of the present disclosure, with body 316 not shown and/or not included. Connector 300 is shown as coupled to rod 1102, which is coupled to body 1104 of beater portion 106. Similar to the connection described with respect to pedal portion 102, cable 208 emerges from connector 300 through a bushing 1106 and a nut 1108. An end of the cable is coupled to a connector 1110 which is coupled to a chain 1112. Chain 1112 is then coupled to arm 324, which is coupled to drive shaft 124. Movement of arm 324 moves (e.g., rotates) drive shaft 124, which moves beater rod holder 126.

Also shown in FIG. 11 is the coupling between body 1104 (which may be coupled to body 316 as described in FIG. 3) and rod 122. A portion 1114 of body 1104 is coupled around rod 122, and a bushing 1116 with an optional washer 1118 are shown. Rotational control 318 is coupled to bushing 1116, and by loosening and tightening bushing 1116 onto rod 122 with rotational control 318, the angle of body 1104 can be adjusted with respect to bracket 120 (and thus with respect to a surface of a drum located proximate to bracket 120). Tightening rotational control 318 (not shown) places pressure against rod 122, thus minimizing movement of the set rotated position of body 1104 with respect to a surface to be struck during play. Other attachment hardware and/or arrangements (including attachment hardware/arrangements included as part of a drum, such as inside a cajón as previously described) may be employed without departing from the scope of the present disclosure.

If desired, a second beater rod holder may be coupled to arm 324, to provide two beaters in a single beater portion 106. The beaters in the two beater rod holders 126 may have different beater heads, such that the two beaters produce two different tones from the same percussive instrument at substantially the same time.

Further illustrated in FIG. 11 is location 1120, which may be a second attachment point for a rod 122 on bracket 120. As such, a second pedal portion 102 and a second connecting portion 104 may be attached to a second beater portion 106 at location 1120. In such an aspect of the present disclosure, the system 100 can provide two pedals to strike two drum surfaces (whether of the same drum or of different drums), a drum surface and a tambourine, and/or any two percussive instruments independently. For example, and not by way of limitation, the second beater portion 106 can be arranged to strike the surface of a tambourine, and the first beater portion 106 can be arranged to strike the surface of a cajón. In such an aspect of the present disclosure, a drummer can approximate the hi-hat and bass drum of a drum set with a much smaller arrangement of pieces. Further, such an arrangement is easier to transport and takes up less room on stage and/or during transport.

Figure 12:
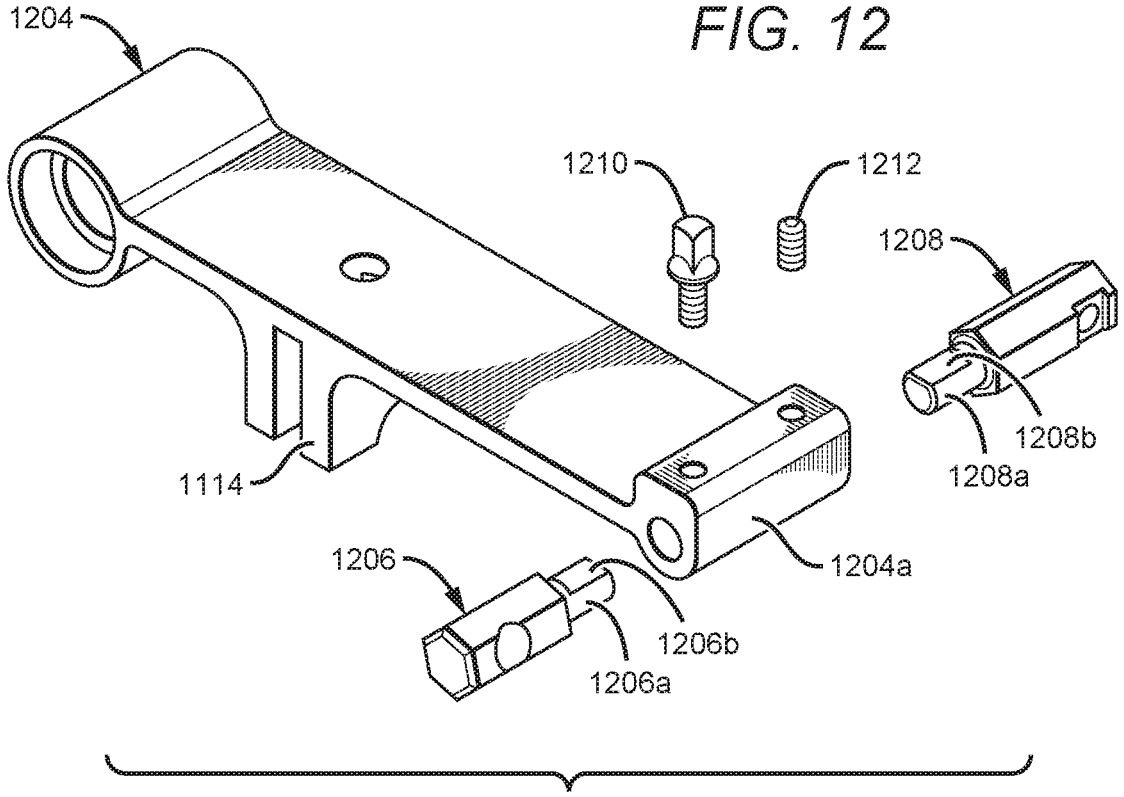
FIG. 12 illustrates a perspective view of alternative embodiments of some components from FIG. 11.

FIG. 12 illustrates an alternative body 1204 that can be used in place of the body 1104 from FIG. 11. The body 1204 also includes the portion 1114, and many other components the same as the body 1104. However, the body 1204 includes a connection portion 1204*a* that is different from the connection portion 1104*a* from FIG. 11. The portion 1104*a* allowed a rod 1102 to pass through, the rod 1102 connecting to the pieces 1107. The portion 1204*a* includes an aperture that enables easy insertion of the pieces 1206,1208 to be inserted (with the pieces 1206,1208 replacing the functionality of the pieces 1107,1109, as well as the rod 1102, from FIG. 11). The pieces 1206,1208 can then be kept in place via screws, such as a drum key screw 1210 and a set screw 1212, respectively (though both may be drum key screws, both may be set screws, the drum key screw and set screw may be switched, or other types of fasteners may be used). The piece 1206 can include an extension portion 1206*a* for fitting into the aperture of the connection portion 1204*a*, and the extension portion 1206*a* can include a flat surface 1206*b*. The flat surface 1204*b* can allow the rotational angle of the piece 1206 to be set, such as via the screw or via the shape of the aperture. Setting that angle such that it cannot be easily changed can allow the angle taken by the cable 104 to be set at an angle that will not cause wear and tear, or worse, breakage; and can help prevent lag in the playing of the percussion system. The piece 1208 can similarly include an extension portion 1208*a* having a flat surface 1208*b*.

Alternative System

A. Exemplary Alternative System Structure

FIGS. 13-18 illustrate a system 1300 similar in some aspects to the system shown in FIGS. 1-3, but with certain different componentry. Much of the componentry can be similar or the same, such as the bracket 120, rods 122, and pedal 108. However, instead of use of a flexible piece such as a cable to connect the pedal and beater portions, the system 1300 utilizes a direct drive assembly 1304 to connect the pedal 1302 of the system to the beater portion 1306 of the system. The componentry of the system 1300 from the body 1204 (or in some embodiments, the body 1104) toward the remainder of the beater portion 1306 can be the same as or similar to that previously described with regard to the other embodiments.

Beginning with the pedal portion 1302, the pedal portion 1302 includes a base 1310. The base 1310 can be longer than traditional pedal assembly bases in order to accommodate extra componentry. For example, in some embodiments the base 1310 can be longer than 12", 15" or longer, 18" or longer, or can be between 12" and 30" long, between 15" and 24" long, or can be approximately 18" long (all inclusive). In other embodiments a standard length base can be used.

The pedal portion 1302 can include a drive shaft 112 with arm 202 (components connecting the drive shaft 112 to pedal 108 are not shown for simplicity, but would be present). However, instead of coupling to a chain as in the system 100, the arm 202 can couple to a link rod 1314, such as via a connector 1312. The link rod 1314 can have a length similar to, slightly shorter than, or slightly longer than the length of the base 1310. In some instances the link rod 1314 can be longer than 12", or between 12" and 30" long, between 15" and 24" long, or approximately 18" long (all inclusive). The link rod 1314 is rigid. However, in other embodiments it may be flexible, such as a chain or rope, to provide more play and lag. The link rod 1314 can connect the front part of the pedal 108 and/or the drive shaft 112 to componentry behind the pedal 108, as will be discussed in more detail below. That componentry can be on the base 1310, which can be enabled due to the extended length of the base 1310.

The link rod 1314 can be connected to a secondary drive shaft 1320, such as by an arm 1316 and connector 1318, though many connection means are possible. The drive shaft 1320 can be behind or to the rear of the pedal 108. The drive shaft 1320 can be mounted on a drive shaft housing 1321, which can be connected to the base 1310. The drive shaft 1320 can include an axle and be connected, such as via connectors 1322,1324, to the direct drive assembly 1304. In other embodiments a single connector instead of the connectors 1322,1324 may be used. The connectors 1322,1324 can be linked such that when the connector 1322 rotates with the drive shaft 1312, there is a direct and rigid rotational connection with the connector 1324. That is to say, while the link between the connectors 1322,1324 may not be rigid in every direction, when the connector 1322 is rotated in the direction shown in FIGS. 13 and 14, the connection may be rigid and cause immediate movement; this can be achieved through, for example, a pin-and-aperture connection, which could allow non-rigidity in other directions. The connectors 1326,1328 on the beater-side of the direct drive assembly 1304 can operate in a similar or the same manner. Similarly, the connection between the pedal-side drive shaft 1320 and the connector 1322, and between the beater-side drive shaft 124 and the connector 1328, can also be rigid, for immediate or practically immediate translation of movement from one piece to another. It is understood that certain connector pairs or other groups of connectors (such as the connector 1322 with the connector 1324, or the connector 1326 with the connector 1328) could be combined.

The joint piece 1350 can include a main body 1352, which can be elongated. The main body 1352 can include apertures on its ends (or in some instances one large connected aperture therethrough, such as an axial aperture), with posts 1354 extending therefrom. In some embodiments, the extent to which the posts 1354 stick out of the main body 1352 is adjustable. For instance, the posts 1354 could be held in place within their respective apertures by holders or fasteners 1356, such as drum key screws. When the holders 1356 are loosened, the distance by which the posts 1354 stick out of the main body 1352 can be changed, and then the holders 1356 can be tightened so as to lock the posts 1354 in place. The posts 1354 can provide a rigid connection to both the pedal portion 1302 and the beater portion 1306. The posts can have many different shapes and cross-sections. For example, the posts can have triangular, square, rectangular, hexagonal, or other cross-sections, with cross-sections having one or more flat sides being advantageous for rigidity of connection. In the specific embodiment shown, both the posts 1354 and the apertures of the main body 1352 have a square cross-section, though many different embodiments are possible. In some embodiments the posts 1354 can stick out from the main body 1352 by 1/16" or more, or between 1/16" and 3", or between 1/8" and 1", or between 1/8" and 3/4", or about 1/4" to 3/8" (all inclusive). It is understood that embodiments outside these ranges are possible.

Figure 15:
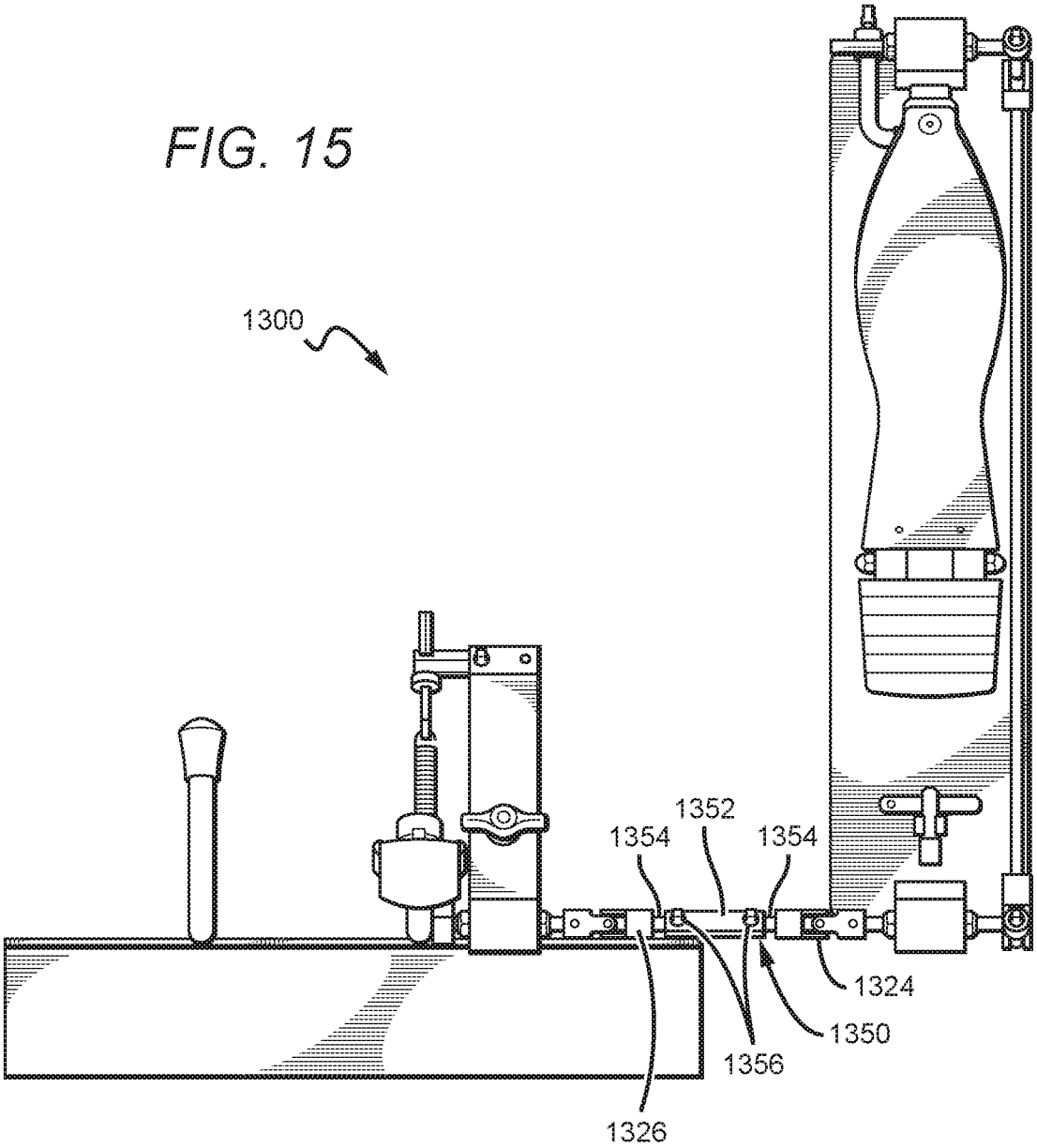
Figure 16:
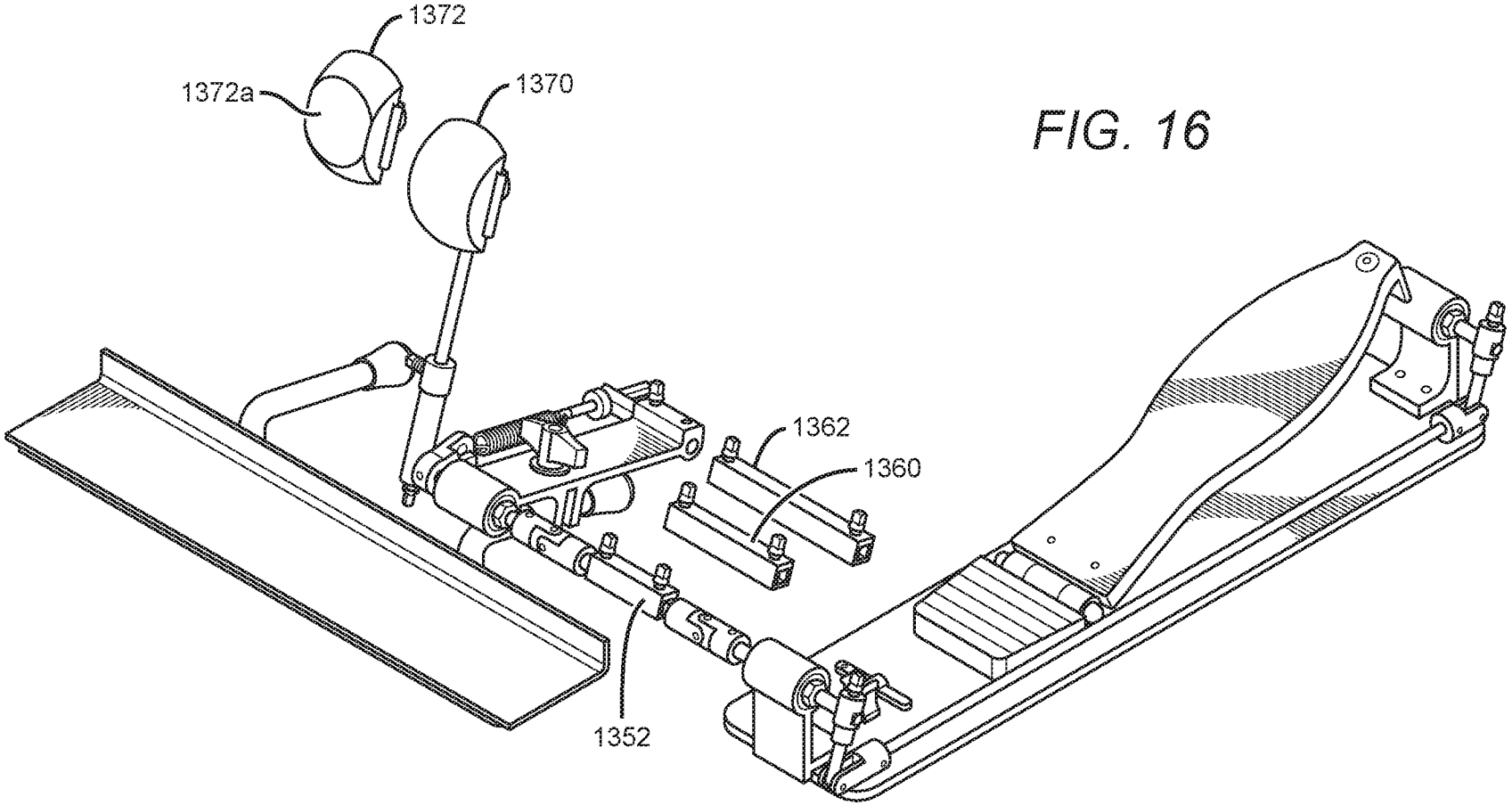
FIGS. 16-18 illustrate the embodiment of a percussion pedal system illustrated by FIGS. 13-15, with embodiments of potential replacement or alternate parts in accordance with an aspect of the present disclosure.

Many different lengths of the main body 1352 are possible. In some embodiments the main body 1352 is greater than 1/2", or between 1/2" and 10", or between 1" and 6", or between 2" and 5" (all inclusive). Many different embodiments are possible. For instance, FIGS. 15-16 show additional main bodies 1360,1362, with the main bodies 1352, 1360,1362 all having different lengths. Different main bodies can be provided with the same percussion pedal system for user convenience; for instance, a percussion pedal system can come with 2", 3", and 4" versions. Embodiments outside of the above ranges are possible.

It is understood that a single post reaching through the entire length of the main body 1352, the single post having an adjustable or non-adjustable length, is also possible. Additionally, the posts 1354 may not be adjustable, may be fixed and/or rigid, or may be part of the main body 1352. In other embodiments, the length by which the posts can extend from the main body is not locked into place by holders, but instead, a maximum reach is set, such as by the internal geometries and interfacing of the posts and aperture (e.g., a part of the post being unable to pass through a part of the aperture). Many different embodiments are possible.

Figure 13:
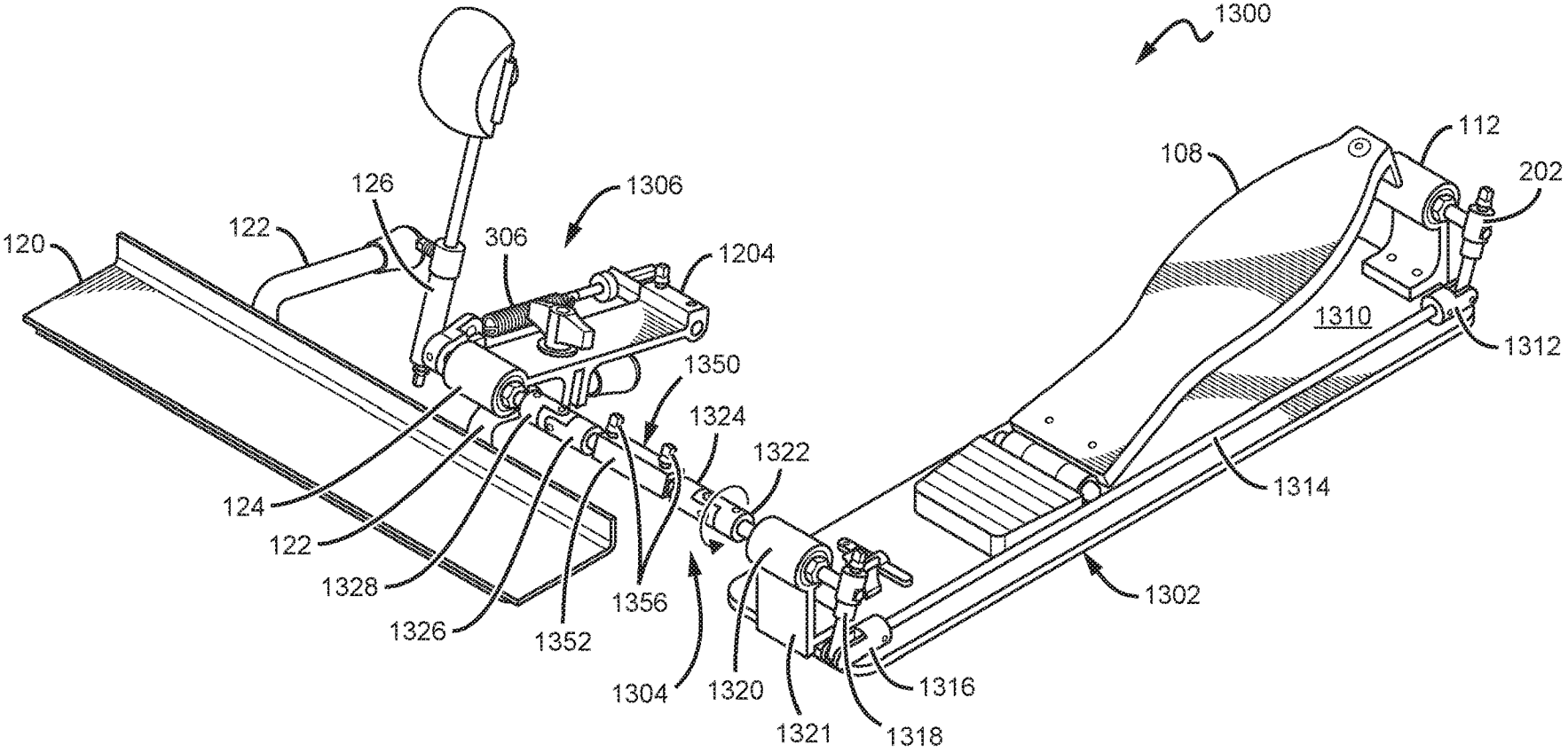
FIGS. 13-15 illustrate one embodiment of a percussion pedal system in accordance with an aspect of the present disclosure.
Figure 14:
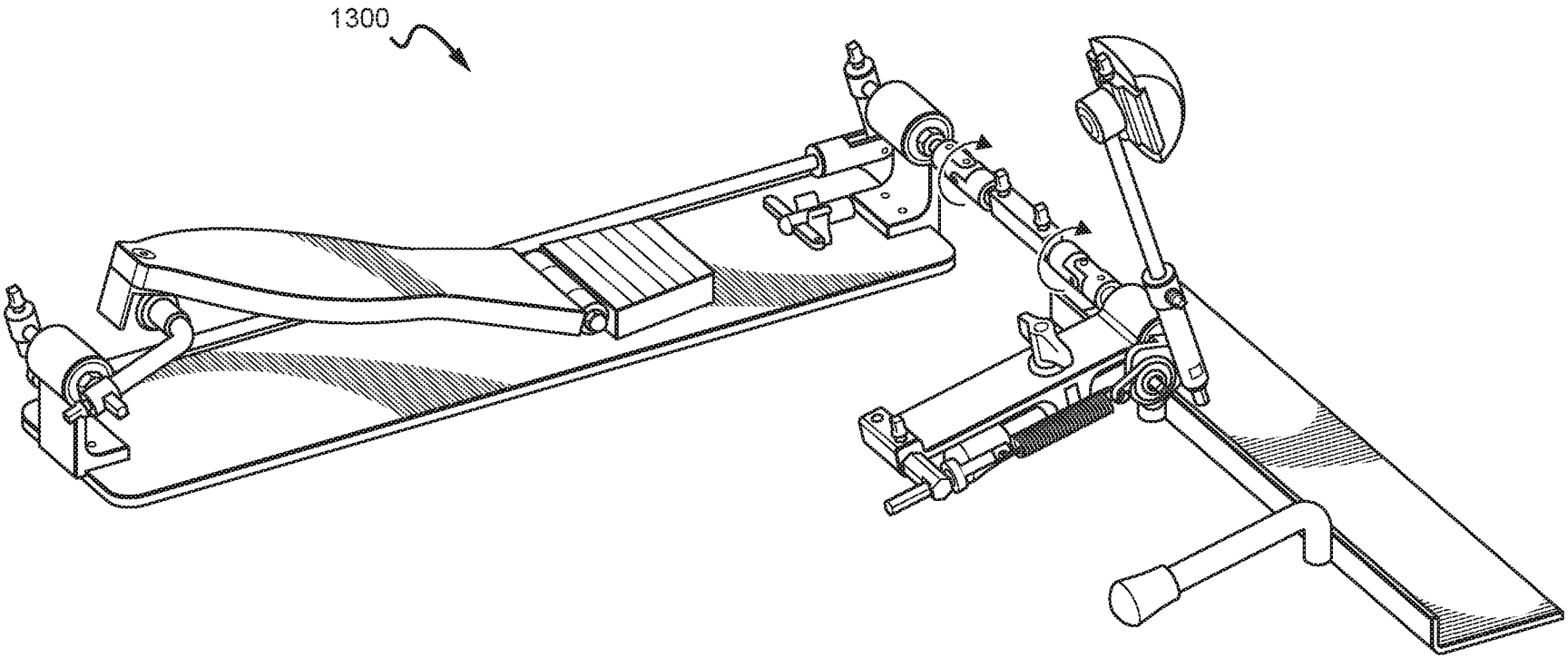

Additionally, while the system 1300 is shown as being configured for a right-footed user, as can be seen in FIGS. 13-15 the system 1300 can also be reconfigured for a left-footed user by the user at his or her option. For example, the link rod 1314 and other components between the link rod 1314 and the drive shafts 112,1320 can be detached (such as by unscrewing attachments) and moved to the left side of the base 1310, where they can be reattached using the same attachment mechanisms. Similarly, the direct drive assembly 1304 can be moved to the right side of the drive shaft 1320. The pedal portion 1302 could be used with a separate beater assembly configured for left-footed playing, or the beater portion 1304 can also be configured to be reversible. For instance, the direct drive assembly 1304 could be detached from the shown side of the drive shaft 124 and attached to the other side, with the beater stem 126, spring 306, and other components also switching sides to swap sides with the direct drive assembly 1304. The beater portion 1306 could also be moved to a different rod, such as the rod 122, which could be preferred by left-footed users.

B. Exemplary Alternative System Operation and Advantages

The below describes typical operation of a percussion pedal system utilizing the components shown in FIG. 13 such as the system 1300. It is understood that variations are possible, and that certain components not present can be substituted for components that are present, components can be added, components can be removed, etc., as would be understood by one of skill in the art. It is also understood that some components of the system can be "reversed" to achieve the same result; for example, instead of forward movement of the link rod 1314 causing the beater rod holder 126 to rotate forward, the system could be arranged such that rearward movement of the link rod 1314 caused the same movement. Such rearrangements, substitutions, combinations, removals, etc. are encompassed by the present disclosure, and the below operation is but one example of operation of a system according to the present disclosure.

Upon a user pressing upon the pedal 108, the drive shaft 112 is actuated and rotates. This rotation engages the arm 202, causing the link rod 1314 to move forward toward the front of the base 1310. This movement engages the arm 1318 which rotates the drive shaft 1320 in the direction shown in FIGS. 13 and 14. This rotation is translated to the joint piece 1350, causing rotation of the posts 1354 and main body 1352 in the same direction, which in turn causes rotation of the drive shaft 124 in the same direction. This rotation causes forward rotation of the beater rod holder 126, which can cause a beater to strike a drum head or face (e.g., a cajón face). The spring 306 can then push the elements of the system back toward their resting positions.

In the embodiment shown, each connection from the drive shaft 112 to the drive shaft 124, and in some embodiments from the pedal 108 to the beater holder 126, is rigid. As such, pressing the pedal 108 causes immediate or near immediate movement of all of the other connecting portions between the pedal and the beater holder. This can have distinct advantages over flexible connections, such as connections using chains, ropes, cords, wires, cables etc. (though it is understood that for certain playing styles, flexible connections may be preferred by a user). For example, the system 1300 can cause there to be little or no lag time between actuation of a pedal and movement of a beater, which can be preferred and/or necessary for precision playing.

Additionally, the system 1300 is less susceptible to wear and tear than systems utilizing cables or wires. Cables or wires, especially when bent to an unusual or unnatural position, can fray and/or break, whereas the rigid components of the system 1300 are much more reliable in this regard.

The use of a drive shaft 1320 and/or housing 1321 can also have distinct advantages. The amount of force being put through the system upon user actuation, especially with actuation by professional drummers, can be very high. A connection from the drive shaft 112 to the drive shaft 124 without a strong intermediary point such as the drive shaft 1320/housing 1321 may tend to fail such as through component dislodgment, because such a system would include all components raised off of the ground and be less stable. The inclusion of a drive shaft 1320/housing 1321 that is supported by the base 1310 lessens the likelihood of and/or prevents such accidental dislodgment.

Running the connection from the pedal portion 1302 to the beater portion 1306 through the rear of the pedal portion 1302 and/or behind the pedal 108 (as opposed to the front, such as directly through the drive shaft 112 to the beater portion 1306, without a link rod 1314 connecting to components to the rear of the pedal 108) also has distinct advantages. The system 1300 is often used to play instruments like a cajón, where the user sits on the drum and also plays the faces of the cajón by hand. Running the componentry of the system through the rear of the pedal portion 1302 allows for the pedal 108 itself, and thus a user's foot, to be in a much more natural position that is often forward of the cajón's front face, as opposed to a position where some or all of the pedal is behind the cajón's front face. The use of a base 1310 that is longer than typical bases is also beneficial in that it allows the pedal 108 to be in an even more forward position. Embodiments of the present disclosure can include bases and/or link rods of adjustable length, which could be used to customize positioning even further.

Beater Heads

Figure 17:
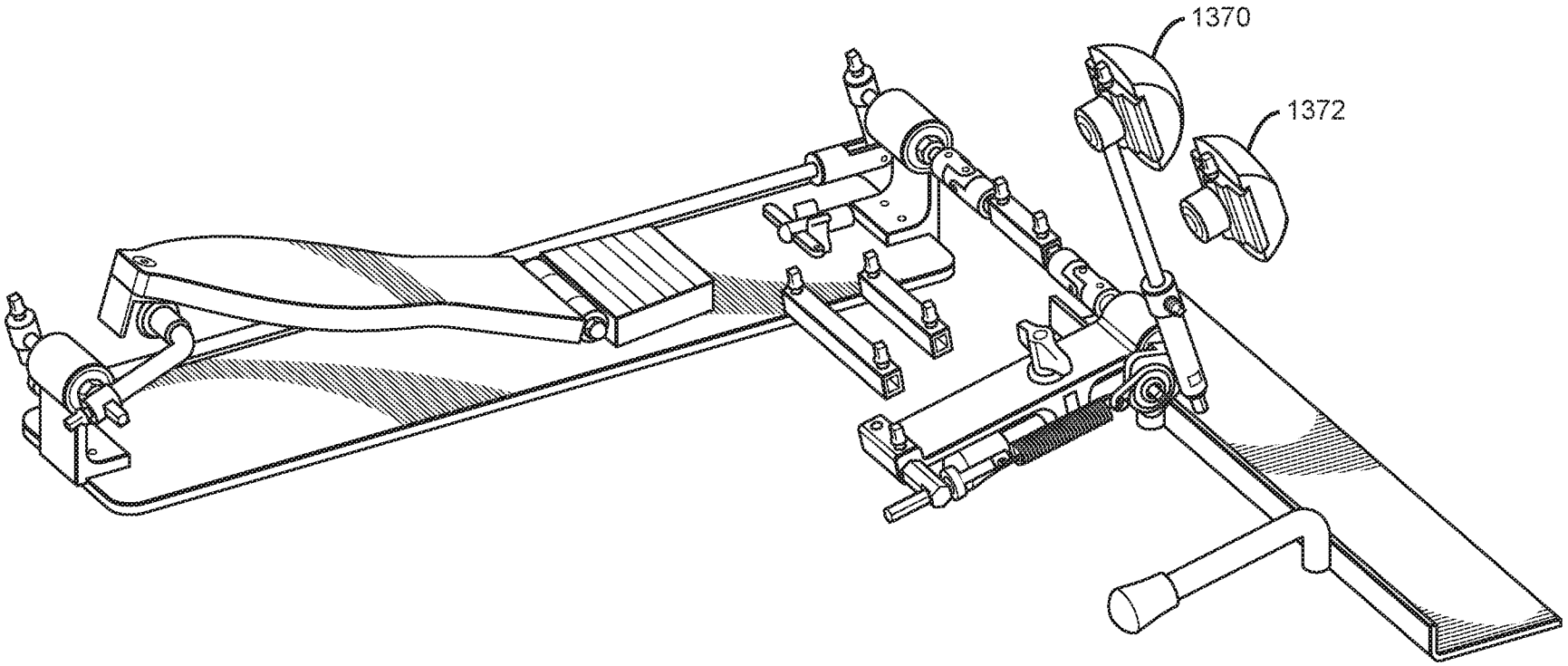
Figure 18:
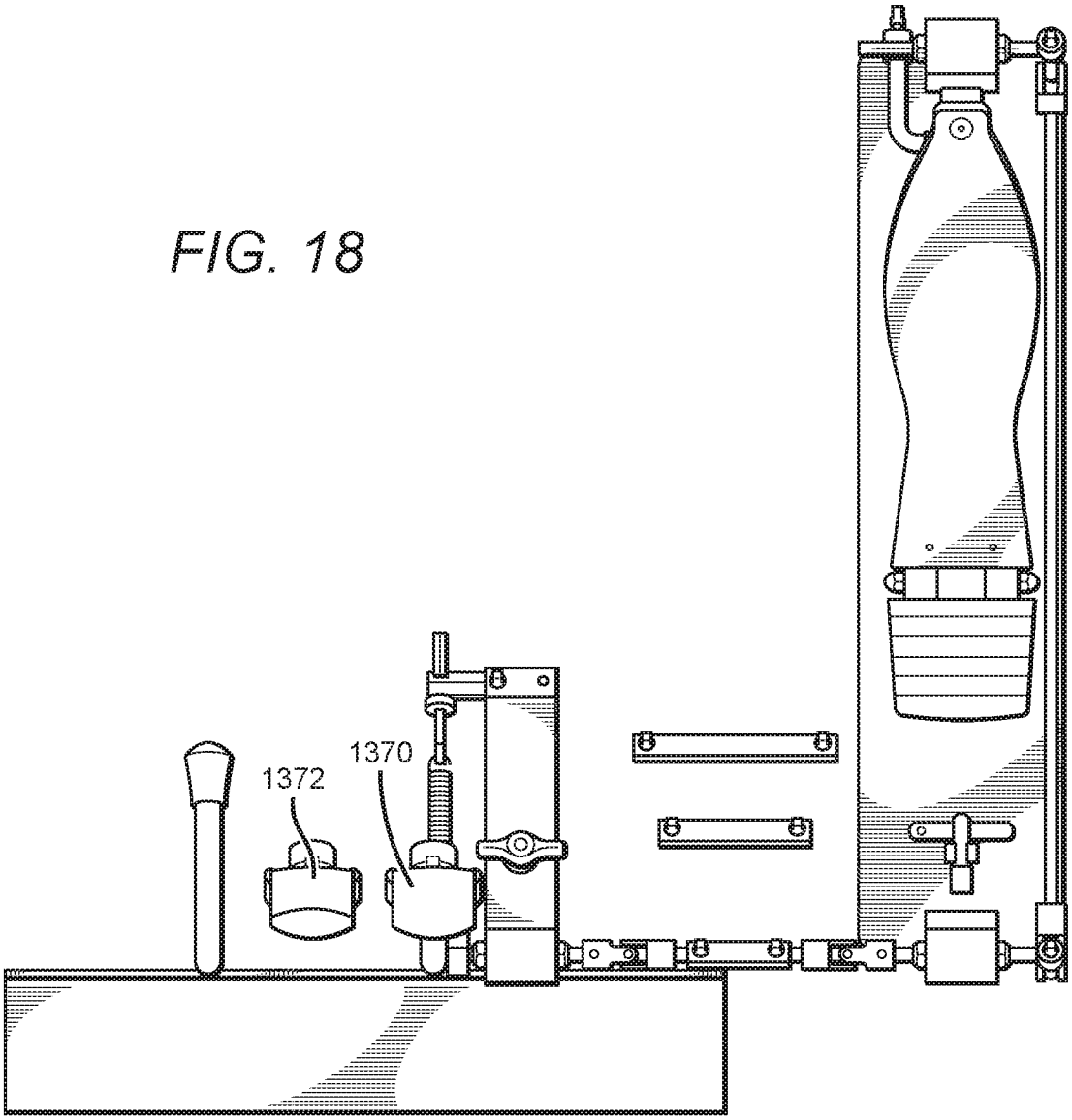

FIGS. 16-18 show beater heads 1370,1372 that can be used in embodiments of the present disclosure. Each of the beater heads 1370,1372 has a substantially flat back, which can each be connected to a beater stem as shown in FIG. 17. The beater head 1370 includes flat side surfaces, and a curved front surface from the top of the flat rear surface to the bottom of the flat rear surface.

The beater head 1372 also includes flat side surfaces, and surfaces that begin to curve from the top of the flat back surface and from the bottom of the flat back surface. However, instead of the front surface curving all the way from the top of the flat back to the bottom of the flat back, the beater head 1372 also includes a flat front surface **1372*a*. The flat front surface 1372*a* can contact a drum, such as a bass drum head or a cajón, with more surface area than a typical beater head, resulting in a fuller and louder sound. The flat front surface 1372*a* can have a surface area of, for example, 0.25 $in^2$ to 6 $in^2$, 0.5 $in^2$ to 4 $in^2$, or 0.75 $in^2$ to 2 $in^2$, all inclusive, and embodiments outside these ranges are also possible. Either of the beater heads 1370,1372** can be used in any embodiments of the present disclosure in place of a traditional beater head.

It is understood that various attributes and elements of from any one embodiment can also be included in other embodiments. Although the present disclosure has been described in detail with reference to certain preferred configurations thereof, other versions are possible. The actual scope of the disclosure encompasses not only the disclosed embodiments, but also all equivalent ways of practicing or implementing the disclosure. The above detailed description of the embodiments of the disclosure is not intended to be exhaustive or to limit the disclosure to the precise form disclosed above or to the particular field of usage mentioned in this disclosure. While specific embodiments of, and examples for, the disclosure are described above for illustrative purposes, various equivalent modifications are possible within the scope of the disclosure, as those skilled in the relevant art will recognize. The elements and acts of the various embodiments described above may be combined to provide further embodiments. Further, the teachings of the disclosure provided herein may be applied to products and systems other than head support devices.

I claim:

1. A percussion pedal assembly comprising:

a base plate;

a pedal on said base plate;

a first drive shaft on said base plate, said first drive shaft at a height below a height of a front end of said pedal;

a second drive shaft behind said pedal and on said base plate; and a rigid link rod connecting said first drive shaft to said second drive shaft.

2. The percussion pedal assembly of claim 1, wherein said base plate is greater than 12 inches long.

3. The percussion pedal assembly of claim 1, wherein said base plate is 15" or longer.

4. The percussion pedal assembly of claim 1, wherein said link rod is greater than 12 inches long.

5. The percussion pedal assembly of claim 1, wherein said link rod is 15" or longer.

6. The percussion pedal assembly of claim 1, wherein said first drive shaft is on a first drive shaft housing that is connected to said base plate, and wherein said second drive shaft is on a second drive shaft housing that is connected to said base plate.

7. The percussion pedal assembly of claim 6, wherein said first drive shaft housing is connected at a front of said base plate and said second drive shaft housing is connected at a rear of said base plate.

8. The percussion pedal assembly of claim 1, wherein said base plate is between 15" and 24" long, and wherein said link rod is between 15" and 24" long.

9. The percussion pedal assembly of claim 1, wherein said first drive shaft is in front of said pedal.

10. The percussion pedal assembly of claim 1, wherein said link rod has a resting position that is substantially horizontal.

11. The percussion pedal assembly of claim 10, wherein actuation of said pedal causes substantially linear forward motion of said link rod.

12. A percussion pedal system comprising:

a percussion pedal assembly comprising a pedal, a first drive shaft at a height below a height of a front end of said pedal, and a second drive shaft behind said pedal;

a beater assembly; and a direct drive connector assembly between said percussion pedal assembly and said beater assembly, said direct drive connector assembly connected to said second drive shaft;

wherein actuation of said pedal causes direct, rigid translational and/or rotational movement of every component operably between said pedal and said beater assembly.

13. The percussion pedal system of claim 12, wherein the connection from the direct drive connector assembly to the percussion pedal assembly, the connection from the direct drive connector assembly to the beater assembly, and all connections within the direct drive connector assembly are rigid connections.

14. The percussion pedal system of claim 12, wherein said percussion pedal assembly further comprises a base plate, and wherein said pedal, said first drive shaft, and said second drive shaft are on said base plate.

15. The percussion pedal system of claim 14, wherein said direct drive connector assembly is substantially perpendicular to said percussion pedal assembly.

16. The percussion pedal system of claim 14, wherein actuation of said pedal causes translational movement of said rigid link rod.

17. The percussion pedal assembly of claim 14, further comprising a rigid link rod connecting said first drive shaft to said second drive shaft.

18. The percussion pedal system of claim 12, wherein said drive shaft and said direct drive connector assembly are substantially coaxial.

19. The percussion pedal system of claim 12, wherein said direct drive connector assembly has an adjustable length.

20. The percussion pedal assembly of claim 12, wherein said first drive shaft is in front of said pedal.

21. The percussion pedal system of claim 12, wherein said direct drive connector assembly comprises a set of interchangeable main bodies of different lengths, for adjusting the length of said direct drive connector assembly.

* * * * *